US011271331B2

(12) United States Patent
Blakborn

(10) Patent No.: US 11,271,331 B2
(45) Date of Patent: Mar. 8, 2022

(54) CONNECTOR ARRANGEMENT

(71) Applicant: Rosenberger Hochfrequenztechnik GmbH & Co. KG, Fridolfing (DE)

(72) Inventor: Willem Blakborn, Inzell (NL)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 17/018,512

(22) Filed: Sep. 11, 2020

(65) Prior Publication Data

US 2021/0083407 A1 Mar. 18, 2021

(30) Foreign Application Priority Data

Sep. 16, 2019 (DE) ..... 10 2019 124 905.8

(51) Int. Cl.
*H01R 9/05* (2006.01)
*H01R 13/508* (2006.01)

(52) U.S. Cl.
CPC ..... *H01R 9/05* (2013.01); *H01R 13/508* (2013.01)

(58) Field of Classification Search
CPC ..... H01R 9/05; H01R 13/508; H01R 9/0518; H01R 13/6592; H01R 2201/26; H01R 2103/00; H01R 13/567
See application file for complete search history.

(56) References Cited

U.S. PATENT DOCUMENTS

| | | | |
|---|---|---|---|
| 5,831,815 | A | 11/1998 | Miller |
| 6,896,549 | B2 | 5/2005 | Feuerreiter |
| 7,507,121 | B1 | 3/2009 | Scea |
| 9,929,491 | B2 | 3/2018 | Yamaguchi |
| 2005/0266729 | A1 | 12/2005 | Fukushima |
| 2014/0235092 | A1 | 8/2014 | Akuta |

FOREIGN PATENT DOCUMENTS

| | | | |
|---|---|---|---|
| JP | 2018129282 | A | 8/2018 |
| KR | 1020100070743 | A | 6/2010 |
| KR | 101348158 | B1 | 1/2014 |
| KR | 101723049 | B1 | 4/2017 |

OTHER PUBLICATIONS

German Search Report dated May 11, 2020, No. 10 2019 124 905.8.
European Search Report dated Dec. 18, 2020.

*Primary Examiner* — Briggitte R. Hammond
(74) *Attorney, Agent, or Firm* — Randall Danskin P.S.

(57) ABSTRACT

A connector arrangement comprises at least at least two cables, each comprising one cable sheath, and respectively one shielding arranged within the cable sheath. The shielding is exposed from the cable sheath at one cable end. The connector arrangement additionally comprises a connector housing made of an electrically conductive material, in which there is realized a respective a leadthrough for each cable. The exposed shielding of each cable is located in the respective leadthrough, and is frictionally connected to the connector housing. The connector arrangement also comprises a crimp barrel. The crimp barrel encloses the connector housing and each leadthrough, and is frictionally connected to the connector housing.

14 Claims, 10 Drawing Sheets

CONNECTOR ARRANGEMENT

CROSS REFERENCE TO RELATED APPLICATIONS

This application is a United States National patent application which claims the benefit of priority to earlier filed German Patent Application No. DE 10 2019 124 905.8, filed on 16 Sep. 2019 and titled "Connector Arrangement". The entire contents of the aforementioned German Patent Application is expressly incorporated herein by this reference. Pursuant to USPTO rules, this reference to earlier filed German Patent Application No. DE 10 2019 124 905.8 is also included in the Application Data Sheet (ADS) filed herewith.

FIELD OF THE INVENTION

The present invention relates to a connector arrangement.

In addition, the invention relates to a first connector housing element for a connector arrangement.

The invention also relates to a method for producing a connector arrangement.

Finally, the invention relates to a device for producing a connector arrangement.

TECHNICAL BACKGROUND

There is an increasing demand for electric and hybrid vehicles. High electrical outputs have to be transmitted between the individual electrical units of an electric or hybrid vehicle, namely the battery and the electric drive. This requires suitably designed high-voltage cables and high-voltage connectors.

In present-day electric and hybrid vehicles, components of the control and communication electronics are installed in a confined space with high-voltage components. The individual components and units interfere with each other through electromagnetic radiation, which can even lead to functional failure. In addition, power-electronics components such as drive inverters generate more than 100 times the amount of electromagnetic radiation than components of the control and communication electronics.

Consequently, an essential technical requirement for the design of high-voltage cables, high-voltage connectors and high-voltage units in electric and hybrid vehicles is the shielding of these components or units, and an optimized shield transfer between these components or units.

The shield transfer between a shielded high-voltage cable and a shielded high-voltage connector housing is preferably effected via a crimp connection. A crimp connection allows an electrical connection with minimized junction resistance between the shielding of the high-voltage cable and the shielding of the high-voltage connector housing. In addition, a crimp connection provides a reliable mechanical connection in the long term.

Frequently, high-voltage connectors are connected, at the cable-side interface, to a plurality of shielded high-voltage cables. As is known, two electric lines are required for a direct-current transmission between the energy source and the energy consumer, whereas a three-phase current transmission requires three electric lines. The separate distribution of a plurality of electric lines to individual high-voltage cables is typically preferred to a common routing of the multiple lines in a single high-voltage cable. In the case of distribution to a plurality of cables that each have a smaller cable cross-section, a smaller bending radius of the cables, and thus a more flexible installation of the cables, can be achieved.

However, connection of a plurality of shielded high-voltage cables to the high-voltage connector requires a crimping process for each individual high-voltage cable. This multiple crimping process for each high-voltage connector adversely affects the process time. Moreover, this disadvantageously requires a more complex geometry for the connector housing and a greater space requirement.

This is a situation that needs to be improved.

SUMMARY OF THE INVENTION

Against this background, the present invention is based on the object, in the connecting of a plurality of cables to a common connector, of specifying a technical solution for time-synchronous connection, in particular for time-synchronous crimping, of a plurality of cables to a common connector.

According to the invention, this object is achieved by a connector arrangement, having the features disclosed and defined herein; by a method for producing a connector arrangement disclosed and defined herein; and by a device for producing a connector arrangement disclosed and defined herein.

There is accordingly provided: a connector arrangement comprising: at least two cables, each of the at least two cables having a cable sheath, and respectively one shielding arranged within the cable sheath, the shielding being exposed from the cable sheath at one cable end, a connector housing made of an electrically conductive material, in which there is realized a respective leadthrough for each cable, the exposed shielding of each cable being located in the respective leadthrough, and being frictionally connected to the connector housing, and a crimp barrel, the crimp barrel enclosing the connector housing and each leadthrough, and being frictionally connected to the connector housing.

A method for producing a connector arrangement, comprising the method steps: providing the at least two cables, each of the at least two cables with the shielding exposed from the cable sheath at the cable end, inserting each cable into the associated leadthrough of the connector housing, and frictionally connecting the connector housing to the crimp barrel.

A device for producing a connector arrangement comprising: a fixed contact for receiving the connector housing, and a crimper that can be moved relative to the fixed contact, and a cross-sectional profile of a cavity enclosed by the fixed contact and the crimper corresponding to a cross-sectional profile of the connector housing.

The knowledge/idea on which the present invention is based consists in realizing an optimized shield transition between the shielding of the connector housing and the shielding of each cable by means of a single crimp barrel that in each case achieves a crimp connection, i.e. preferably a frictional connection, between the shielding of the connector housing and the shielding of each cable.

For this purpose, the shielding of the connector housing is realized in that the connector housing is made of an electrically conductive material. In addition, the shielding of each cable is exposed from the cable sheath at the cable end.

In order to realize a frictional transition between the shielding of each cable and the shielding of the connector housing, realized in the connector, for each cable, there is a respective leadthrough, through which the individual cable is led from the outside into the interior of the connector housing. In addition, each cable is led through the associated leadthrough in the connector housing in such a manner that the exposed shielding is located in the associated leadthrough. The exposed shielding of each cable is in each case frictionally connected to the connector housing within the associated leadthrough. In order to achieve the frictional connection between the shielding of each cable and the connector housing made of electrically conductive material, a crimp barrel is additionally provided, which encloses the connector housing and the leadthroughs realized in the connector housing, and which is frictionally connected to the connector housing. When frictionally connected, the crimp barrel lies on a bearing surface of the connector housing that encloses a region of the connector housing in which all leadthroughs are realized.

A plurality of cables can be frictionally connected to a connector housing simultaneously in a single crimping operation.

The number of a plurality of cables connected to the connector is preferably two cables in the case of direct-current transmission, and three cables in the case of three-phase transmission. In addition, the invention also covers a higher number of a plurality of cables, for example, only but not limited to four cables or six cables.

"Crimping" in this case and in the following is understood to be a joining method in which at least two components are joined together by plastic deformation. Also conceivable is the case whereby one component is plastically deformed while the other component is either plastically or only elastically deformed. In the connector arrangement according to the invention, the crimping process plastically or elastically deforms the crimp barrel, the connector housing and the shielding of the individual cable. In this way, a homogeneous frictional connection is created between the shielding of the individual cables and the connector housing, as well as between the connector housing and the crimp barrel. This homogeneous frictional connection allows a stable mechanical and electrical connection between the shielding of the individual cables and the electrically conductive connector housing, as well as a stable mechanical connection between the crimp barrel and the connector housing. Besides the reliability of connection, the crimp connection makes it possible to achieve a connection technology that is easily manageable and thus suitable for series production. Details of the crimping process and crimping tool that are essential to the invention are discussed below.

Since the connection of a plurality of cables to a single connector is used, in particular, in the high-voltage domain, the cables are each preferably realized as high-voltage cables, and the connector realized as a high-voltage connector.

The high-voltage cable is realized, in particular, as a shielded high-voltage cable. Such a shielded high-voltage cable typically includes an inner conductor, which comprises a bundle of litz wires that are preferably stranded together. The inner conductor is enclosed by an insulation. The insulation in turn is enclosed by a shielding. A shielding, also known as a shield or as an outer conductor shield, or outer conductor shielding, typically comprises a mesh of interwoven metallic wires. In rare cases, a shield is also realized as a metal foil, or as a combination of metal foil and metal wire mesh. Finally, the shielding is enclosed by a cable sheath made of an electrically insulating material.

The shielding of the high-voltage connector is preferably effected by a shielded housing of the high-voltage connector. Besides a metal-coated plastic housing, the shielding of the housing may also be realized by a connector housing made of an electrically conductive material. In order to save the additional production step of coating, a connector housing made of an electrically conductive material, i.e. preferably of a metal, is typically used. In order to reduce the weight of the metallic connector housing, a large part of the connector housing, with the exception of the load-bearing parts of the connector housing, is of a shell-type design. In the following, a shell-type connector housing, or a shell-type connector housing element, is understood to be a housing, or housing element, of which the thickness of the housing wall is reduced significantly in relation to the surface area of the housing wall.

For weight reasons, aluminum is preferred as the electrically conductive material for the connector housing. In addition, however, zinc, brass, bronze, steel or suitable alloys may also be used to form the connector housing although the connector housing is not limited to these identified materials.

To realize the shield transition between the shielding of the individual cables and the shielding of the connector, the shielding of the individual cable is exposed at the cable end that is inserted into the connector.

To realize an optimized shield transition between the shielding of each cable and the connector housing made of electrically conductive material, a respective leadthrough must be provided in the connector housing for each cable. The geometry of the leadthrough, i.e. the cross-sectional profile of the leadthrough, must be adapted to the geometry, or cross-sectional profile, of the cable, in particular in the region of the exposed cable shielding. Since in most cases the cable has a round cross-sectional profile, or approximately a round cross-sectional profile, in the region of the exposed shielding, the cross-sectional profile of the leadthrough must also be round. In the significantly less common case of a flat ribbon cable, a cable having a square, rectangular, elliptical or otherwise shaped cross-sectional profile in the region of the exposed shielding, the cross-sectional profile of the associated leadthrough must accordingly be designed to be of a square, rectangular, elliptical or other shape to facilitate the connection with the respective cable.

The size of the leadthrough must be adapted to the size of the cable in the region of the shielding in such a manner that the cable can be easily inserted into the associated leadthrough during the assembly process and, at the same time, a reliable frictional connection between the cable shielding and the connector housing can be produced in the crimping process.

The high-voltage connector may be realized as a straight connector or as an angled connector. Other technical functions of a high-voltage connector such as, for example, contacting, sealing, heat dissipation, mechanical stabilization, etc. are not explained here, as they are not essential to the invention. These may be realized by means of usual and known technical measures.

Advantageous designs and developments are disclosed by the provided description and with reference to the figures of the drawings.

It is to be understood that the features cited above and those explained in the following are applicable, not only in the respectively specified combination, but also in other combinations or singly, without departure from the scope of the present invention.

In a preferred embodiment, the shielded cable includes a support sleeve. A support sleeve, which is preferably made of a metal, is passed over the cable sheath. The shielding is folded back around and about the support sleeve at the cable end. The support sleeve may also be made of a non-metal. A support sleeve may preferably also be made of an elastic material, provided that the elastic material realizes the hydrostatic pressure. Thus, non-relaxing rubber is also suitable as a material for a support sleeve.

The size and cross-sectional profile of the leadthrough is preferably constant over the entire leadthrough length. Alternatively, the leadthrough may also be of a conical shape, i.e. have a greater cross-section at the inner end of the housing than at the outer end of the housing. In this way, the crimping process achieves a form-fitting connection between the shielding of the cable and the connector housing in addition to the frictional connection. The extraction force, and the compressive load by the connector housing upon the shielding of the cable, are improved by the additional form-fitting connection. In addition to a conical shape, a concavely or convexly curved leadthrough, or a stepped leadthrough, is also conceivable for realization of a form-fitting connection.

The use of differing manufacturing technologies in the production of electrically conductive connector housings, such as casting, punching and bending, punch packing, extrusion, etc., makes it possible to design connector housings having a multiplicity of differing geometries and differing numbers of connector housing elements.

In a first embodiment, the connector housing is made in one piece from a single connector housing element. In this connector housing element, a respective leadthrough is formed for each cable. As has already been mentioned, the size and the cross-sectional profile is adapted to the size and the cross-sectional profile of the cable in the region of the shielding, in particular in the region of the support sleeve having the turned-over shielding.

Such a connector housing may preferably be produced by means of casting or punch packing. In the case of punch packing, the connector housing element is made from a plurality of identical sheet metal lamellae that have punched-out leadthroughs. The individual punched sheet-metal lamellae are stacked and pressed together in the region of the leadthroughs. Finally, the individual sheet-metal lamellae, pressed together, are bent to form a connector housing.

Plastic, or elastic, deformation of the connector housing in the region of the leadthroughs can be achieved in a crimping process by forming slots in the connector housing, in the region of the leadthroughs. The slots are preferably closed in the crimping process. The plastic, or elastic, deformation of the region of the connector housing in which the leadthroughs are realized creates a frictional connection between the shielding of each cable and the connector housing. The individual slot preferably extends along the entire length of the leadthrough, and is realized in the connector housing, adjacent to the individual leadthrough, preferably oriented radially in relation to the leadthrough.

In a preferred second embodiment, the connector housing is of a multipart design. In this case, the individual leadthroughs of the connector housing are realized in at least one connector housing element. The at least one connector housing element, in which the individual leadthroughs are realized, is in each case referred to in the following as a first connector housing element. The at least one first connector housing element in this case forms the region of the connector housing in which the crimp connection is realized. In order to realize a complete connector housing, the connector housing additionally comprises at least one further connector housing element, which in each case in the following is referred to as a second connector housing element. These second connector housing elements are preferably each of a shell-type design. The at least one second connector housing element is arranged between the crimp barrel and the at least one first connector housing element. In this way, a frictional connection between the at least one first connector housing element and the at least one second connector housing element is realized. Thus a self-contained and mechanically stable connector housing is created. In addition to the frictional connection, a form-fitting connection can be achieved by a corresponding shaping of the outer wall of the at least one first connector housing element and the inner wall of the at least one second connector housing element.

The individual first connector housing element is in each case preferably formed in the shape of a disk. In the crimping process, the crimping tool applies to the connector housing, and thus to the individual first connector housing element, a crimping force that is directed laterally in relation to the longitudinal extent of the leadthroughs. When the individual first connector housing element is formed in the shape of a disk, this laterally applied crimping force is converted into the best possible holding force, and thus into the best possible frictional connection, between the connector housing and the cable.

The disk-shaped first connector housing element has two mutually parallel end-face surfaces, which are axially spaced at a lesser distance than the lateral extent of the first connector housing element. In less common cases, the end-face surfaces may also not be parallel to each other. A concave or convex curvature of the end-face surfaces is also conceivable.

The single first connector housing element is preferably produced in a casting process, especially in a die-casting process. Alternatively, a forming process such as, for example, extrusion or impact extrusion is also conceivable. In a less common case, punch packing or a machining process is also conceivable.

The material used and the geometry that can be achieved by means of the casting, forming or machining process enables the production of a first connector housing element that is plastically and/or elastically deformable in the crimping process. In addition, suitable selection of the material and of the geometry of the individual first connector housing element makes it possible to achieve at least a low-loss transmission of the crimping force, exerted by the crimping tool upon the crimp barrel, to the holding force with which the connector housing holds the cables can be achieved.

The second connector housing element, which is preferably realized in the form of a shell, may be produced by pressing or punching and subsequent bending. A deep-drawing or casting process is also conceivable.

For the purpose of axially and rotationally fixing the individual first connector housing element to the at least one second connector housing element, in a preferred first version there is a fixing region realized on the first connector housing element. This fixing region forms a form-fitting connection to a corresponding fixing region realized on a second connector housing element. The corresponding fixing region may also be realized jointly by two adjacent second connector housing elements.

The fixing region may be realized, for example, as a hook-shaped, pin-shaped, plate-shaped or lamellar extension of the first connector housing element, which extends in the axial and tangential directions at the lateral boundary of the first connector housing element. This hook-shaped, pin-shaped, plate-shaped or lamellar extension is inserted in a form-fitting manner in each case into a correspondingly shaped recess, which is formed on the inner wall of the second connector housing element. In the following, lateral boundary of the first connector housing element is understood to mean the outer wall of the first connector housing element adjacent to the inner wall of the second connector housing element, which is arranged laterally in relation to the longitudinal axis of the preferably disk-shaped first connector housing element.

The first connector housing element may have only one fixing region. Alternatively, a plurality of fixing regions may also be realized, distributed over the lateral outer wall of the first connector housing element.

In a first sub-variant of the second embodiment of the connector housing, all leadthroughs are realized in a single first connector housing element.

In order to ensure a secure frictional connection between the shielding of the individual cables and the first connector housing element, the first connector housing element should completely enclose the cable shielding when in the compressed, or crimped, state.

In the case of two cables connected to the connector, the two leadthroughs must be arranged in a first connector housing element having a preferably elliptical or oval cross-sectional profile. In this case, each leadthrough, when in the compressed state, is preferably completely surrounded by the first connector housing element. The two leadthroughs are in each case arranged adjacent to each other in the longer axis of the elliptical or oval cross-sectional profile of the first connector housing element. The elliptical or oval cross-sectional profile of the first connector housing element thus forms a comparatively thin wall thickness, between the individual leadthrough and the outer wall of the first connector housing element, over an approximately semi-circular region that extends at the axial ends of the longer axis of the ellipse or oval. This promotes the plastic or elastic deformation of the first connector housing element necessary for the crimping process, in particular in this region. Alternatively, a first connector housing element having a round cross-sectional profile is also conceivable.

In the case of three cables connected to the connector, the leadthroughs may also be arranged in a row next to each other in a connector housing element having a preferably elliptical or oval cross-sectional profile. Alternatively, the three leadthroughs may be arranged in a triangular shape in relation to each other in a connector housing element having a cross-sectional profile that corresponds to lobed constant-diameter shape. This is a cross-sectional profile having three angular segments evenly distributed along the circumference with an equal radius and/or arc length. An asymmetrical triangular arrangement of the three leadthroughs is also conceivable.

In a modification of the first sub-variant of the second embodiment, the individual leadthroughs may also in each case be realized in a plurality of first connector housing elements. The individual leadthrough in this case is realized entirely in a single first connector housing element. In particular, in each case each leadthrough may be realized in a single associated first connector housing element. The individual first connector housing elements in this case are arranged and fastened to one another in such a manner that, as in the case of realization of a single first connector housing element, they jointly realize a connector housing region having an elliptical, oval, round or polygonal, in particular rounded polygonal, cross-sectional profile.

In a second sub-variant of the second embodiment, the individual leadthrough may in each case be formed by two or more first connector housing elements. For this purpose, a recess is formed and arranged in each of the individual first connector housing elements, and the individual first connector housing elements are arranged relative to one another in such a manner that the recesses of the individual first connector housing elements together realize the leadthrough. These recesses are referred to in the following as first recesses.

The individual first connector housing elements in this case are likewise formed in the shape of a disk and, when arranged in relation to each other, realize a common connector housing region having an elliptical, oval, round or polygonal, in particular rounded polygonal, cross-sectional profile.

As a result of the crimping process, the plurality of first connector housing elements arranged in relation to one another are each plastically and/or elastically deformed in such a manner that the cross-sectional profile of the individual first recesses and the leadthroughs formed jointly by the first recesses is reduced. In this way, a frictional connection is created between the shielding of the individual cables and the connector housing within the individual leadthroughs.

In a preferred design of the second embodiment of the connector housing, there are recesses, which in the following are referred to as second recesses, realized in individual regions of the first connector housing element in which no respective leadthrough is realized. These second recesses are each realized in the first connector housing element in such a manner that a first rib-shaped region, which at least partially delimits a leadthrough, and a second rib-shaped region, which at least partially realizes a lateral outer wall of the first connector housing element, are thereby realized. Finally, the second recesses also realize a third rib-shaped region extending between a second rib-shaped region and a third rib-shaped region.

Preferably, the third rib-shaped region is in each case aligned perpendicularly in relation to the first rib-shaped region and the second rib-shaped region. In this way, a crimping force directed from the crimp barrel perpendicularly onto the second rib-shaped region of the first connector housing element is routed perpendicularly onto the first rib-shaped region, and thus radially to the leadthrough, to realize a holding force between the connector housing and the cable.

Thus, in the case of a first connector housing element having a non-rotationally symmetrical cross-sectional profile, i.e., for example, an oval, elliptical or polygonal cross-sectional profile, the crimping force that is introduced non-radially in relation to the individual leadthrough by the crimping tool, via the crimp barrel, onto the first connector housing element is deflected into a holding force that is directed radially in relation to the individual leadthrough. In this way, a rotationally symmetrical, homogeneous, frictional connection is achieved between the shielding of the individual cables and the connector housing.

In addition to the deflection of the non-radially introduced crimping force into a radial holding force, the realization of second recesses in the first connector housing element is also advantageously achieved by a reduction of weight in the connector housing.

If, during casting of the first connector housing element, the parting plane is arranged in a cross-sectional plane between the two axial ends of the first connector housing element, and the second recesses in each case are preferably realized axially on the end-face surfaces of the disk-shaped first connector housing element, such a realization of second recesses in the first connector housing element results in a more uniform distribution of the casting compound over the entire extent of the connector housing, and thus regions of the first connector housing element, with comparatively similar wall thicknesses.

In a preferred embodiment of the first connector housing element, the parting plane is completely filled with a material. The second recesses, which are each realized on the end-face surfaces of the first connector housing element, are thus separated from each other. The material-filled parting plane of the first connector housing element thus allows optimum shielding of electromagnetic radiation between the inside of the housing and the outside of the connector. The material-filled parting plane may be arranged centrally between the two end-face surfaces of the first connector housing element. Preferably, however, the material-filled parting line is arranged on the inner housing surface or in the region of the inner housing surface of the first connector housing element, since in this way a conical, form-fitting connection between the first connector housing element and the cable shielding can be realized in addition to the frictional connection. Alternatively, it is conceivable to realize second recesses, which extend between the two end-face surfaces of the first connector housing element without realizing a material-filled parting plane.

In the second sub-variant of the second embodiment of a connector housing, in the casting process the parting plane may alternatively also be arranged in an axial direction of extent of the first connector housing element, i.e. in a direction parallel to the longitudinal extent of the leadthroughs.

In this case, second recesses may be realized in the regions of the first connector housing element where no leadthroughs are realized. These second recesses in this case are formed and arranged in such a manner that in each case fourth rib-shaped regions are realized parallel to the end-face surfaces of the first connector housing element. In addition, the arrangement and shaping of the second recesses may result in the realization of fifth rib-shaped regions, which are arranged between the fourth rib-shaped regions and connect the fourth rib-shaped regions to each other.

This technical measure, also, allows a uniform distribution of the casting compound over the entire extent of the first connector housing element, and thus regions of the first connector housing element, with comparatively similar wall thicknesses. Moreover, the weight of the first connector housing element is additionally reduced.

If a plurality of first connector housing elements are used, they may preferably be joined together by means of corresponding guide regions. In this way, the individual first connector housing elements are already fixed to each other with the individual cables in the assembly process. This fixing of the individual first connector housing elements by means of corresponding guide regions is essential, especially in the crimping process, since the correct arrangement of the shielding of the individual cables in the associated leadthroughs of the connector housing, the correct arrangement of the individual first connector housing elements in relation to each other and the correct arrangement of the crimp barrel in relation to the individual first connector housing elements are absolutely necessary for the realization of a reliable crimp connection.

The guide regions, which are each realized in the first connector housing elements that can be joined together, may be implemented, for example, as a guide rib and as an associated guide groove. Alternatively, a guide pin or a guide tongue may also be realized, which correspond to a guide bore or a guide recess. Interlocking guide lamellae are also conceivable. The individual formations of a guide region may also be multiple. For example, a guide region may be composed of a comb of a plurality of guide ribs, which is inserted into a corresponding comb of a plurality of guide grooves of the opposite guide region. The mutually corresponding guide regions are each realized in the contact regions of the first connector housing elements that, respectively, are arranged adjacent to each other. In this way, they additionally prevent litz wires of the outer conductor shielding from penetrating into the gaps between a plurality of first connector housing elements.

The joining together of a plurality of first connector housing elements may alternatively also be realized via the fixing regions already described above, which in each case are formed between a first connector housing element and at least one second connector housing element.

For the purpose of axially fixing the shielding of the individual cables in the associated leadthroughs of the connector housing, in each case at least one radial extension is realized on the connector housing, at at least one axial position in the leadthrough.

If the individual cables are inserted axially into the leadthroughs realized in the connector housing, in each case a radial extension is realized on the individual connector housing elements, in the region of the leadthrough, only at an axial position within the leadthrough, namely at a position at the end on the inside of the housing, or adjacent to the end of the leadthrough on the housing side. The shielding of the individual cable that is folded back around and about the support sleeve is supported by this radial extension. Thus, in the case of a process of axial joining of the individual cable, it is possible to realize at least one axial fixing of the cable to the connector housing, in an axial direction.

If the individual cables can be inserted sideways, or laterally, into the associated leadthroughs of the connector housing according to the second sub-variant of the second embodiment of the connector housing, then in each case radial extensions, directed radially into the respective leadthrough, may be realized in the individual connector housing elements, at two axially spaced positions within the individual leadthroughs. In this way, axial fixing of the cable in both axial directions within the connector housing is possible.

A full-circumference web, realized on the inner wall of the first connector housing element, may preferably serve as a radial extension of the first connector housing element that is realized at at least one axial position within the individual leadthrough. Alternatively, a plurality of webs may be provided, each distributed on the inner wall of the first connector housing element and each extending only over an angular segment of the inner wall circumference. In particular, the radial extension of the first connector housing element, at the end of the leadthrough on the inside of the housing, extends over the full circumference, since it additionally prevents litz wires of the outer conductor shielding from connecting electrically to litz wires of the inner conductor, and thus a short-circuit connection. At the end of the leadthrough on the outside of the housing, on the other hand, a plurality of radial extensions of the first connector housing element are preferably realized, each in a reduced angular segment, since this design has a lesser stiffness, and thus a lesser risk of breakage, compared to a full-circumference design. Instead of a radial extension of the first connector housing element, a collar on the support sleeve for axial fixing is also conceivable.

For plastic or elastic deformation of the connector housing, in particular of the leadthroughs realized in the connector housing, slots are realized in the connector housing in the non-compressed state. These slots are in each case realized either between two leadthroughs or between a leadthrough and a lateral boundary of the connector housing. The individual slot preferably extends along the entire length of the leadthrough, and is realized in the connector housing, adjacent to the individual leadthrough, preferably oriented radially in relation to the leadthrough.

The plastic, or elastic, deformation of the connector housing, in particular of the first connector housing elements, during the crimping process, causes the individual slots to significantly reduced in respect of their slot width, preferably closed. In this way, the cross-sectional profile of the individual leadthrough is reduced, such that a reliable frictional connection between the cable shielding and the connector housing can be achieved. A closed slot may be identified on the inner wall of the first connector housing element, even in the crimped state. On the inner wall of the first connector housing element, there may preferably be a single slot or, alternatively, a plurality of slots.

The individual slot is preferably designed as an open or closed gap, which connects either two leadthroughs to each other, or one leadthrough to the lateral boundary of the first connector housing element, in a direct connection, i.e. in the shortest possible connection. In the case of the connection between two leadthroughs, the single slot may alternatively also be realized as an open or closed channel, which is realized between a groove-shaped formation of the first connector housing element and a rib-shaped formation of the same, or of another first connector housing element, that is inserted in the groove-shaped formation.

As already mentioned, realization of a frictional connection between the shielding of the individual cables and the connector housing requires a crimp barrel, which encloses the connector housing and all leadthroughs and which is connected to the connector housing in a frictional manner.

The crimp barrel may be realized either as a closed band or as an open band, the ends of which are preferably connected to each other in a form-fitting manner, for example by means of a clinch connection, after joining.

The axial width of the crimp barrel preferably corresponds to the axial extent of the at least one first connector housing element. Alternatively, the axial width of the crimp barrel may also be greater than the axial extent of the at least one first connector housing element. The crimp barrel is preferably axially aligned, on the bearing surface of the connector housing, in relation to the axial position of the at least one first connector housing element. Alternatively, the crimp barrel may be offset axially in relation to the at least one first connector housing element.

The crimp barrel may be connected to the connector housing not only frictionally, but also in a form-fitting or materially bonded manner. As soon as the crimp barrel rests on the bearing surface of the connector housing, it is in this case preloaded in the circumferential direction, and exerts a compressive force upon the connector housing. The crimp barrel may be fixed to the connector housing in this case by a material bond, e.g. by a spot weld or solder joint, or in a form-fitting manner, for example by latching means that in each case are realized on the crimp barrel and the connector housing and correspond to each other.

It should be mentioned at this point that, in the crimping process, in combination with the frictional connection between the shielding of the individual cables and the connector housing, a materially bonded connection, in particular a locally limited materially bonded connection, is also possible. Such a materially bonded connection is possible in a cold welding operation, due to the relative movement between the crimp barrel and the connector housing, and between the connector housing and the shielding of the individual cables.

This crimp barrel, in the non-pressed state, has a cross section that is preferably greater than the cross section of the connector housing in the region of the leadthroughs, in order to allow the connector housing to be easily enclosed by the crimp barrel. In the compressed state, the cross-sectional profile of the crimp barrel is no longer round, but adapted to the cross-sectional profile of the individual first connector housing element, or to the cross-sectional profile of the first connector housing elements that are joined together. The cross-sectional profile of the crimp barrel in the compressed state also results from the cross-sectional profile of the closed crimping tool. It can thus assume an elliptical, oval, round or any other suitably rounded polygonal shape.

In addition, the circumference of the crimp barrel, which in the compressed state bears frictionally against the connector housing, is reduced compared to the round circumference of the crimp barrel in the non-compressed state. From the excess length of the crimp barrel that thus results from the crimping process, the crimping tool realizes at least one fold-shaped portion, preferably two fold-shaped portions, which each project from the connector housing or bear against the connector housing. Since the crimp barrel is subjected to tensile forces during the crimping process due to the crimping force of the crimping tool, such a crimp is also known as a tension belt crimp.

The realization of fold-shaped portions of the crimp barrel may also be avoided if the crimp barrel is brought by the crimping tool into an axial flow process in which, instead of an excess length, an axial widening of the crimp barrel is achieved.

Also conceivable, as an alternative to the tension belt crimp, is a crimp barrel of which the circumference is compressed in the crimping process, and thus does not create any excess length. Such a crimp barrel is preferably realized as a twelve-edged crimp barrel, since a crimp barrel having twelve edges best approximates to an elliptical, or oval, cross-section. Also conceivable, however, is a crimp barrel having a lesser or greater number of edges. A polygonal crimp may have, for example, up to 100 edges, preferably up to 20 edges, particularly preferably eight to 16 edges, and very preferably ten to 14 edges.

In a preferred version of the invention, the individual support sleeves additionally have a plurality of depressions and/or elevations. These depressions and/or elevations realized on the support sleeve are each preferably annular in shape. Alternatively, the depressions and/or elevations of the support sleeve may also be achieved by knurling the surface of the support sleeve. The shielding of the cable is passed in the longitudinal direction of the support sleeve in a form-fitting manner along the individual recesses and/or elevations, and is thus additionally axially fixed. In this way, the pull-out force of the cable is increased.

The invention additionally relates to a first connector housing element for a connector arrangement.

The invention additionally relates to a method for producing a connector arrangement. For this purpose, at least two cables are provided, each comprising a shielding and a cable sheath that encloses the shielding. In addition, the shielding of each cable in this case is exposed from the cable sheath at the cable end. In a further production step, each cable is inserted into the associated leadthrough respectively realized in the connector housing. Finally, in a further production step, the connector housing is frictionally connected to a crimp barrel.

As a result of the connector housing being frictionally connected to the crimp barrel, the shielding of each cable also becomes frictionally connected to the connector housing. For this purpose, the crimp barrel encloses the connector housing and the leadthroughs realized in the connector housing.

Preferably, the crimp barrel is already passed over the connector housing in the region of the leadthroughs before the cables are inserted into the associated leadthrough of the connector housing. In this case, the at least one connector housing element, with the inserted cables, is then inserted into the at least one second connector housing element, over which the crimp barrel is already placed.

Alternatively, however, it is also possible to pass the crimp barrel over the connector housing only after the cables have already been inserted into the associated leadthroughs of the connector housing, and the at least one first connector housing element has been inserted, respectively, into the at least one second connector housing element.

The invention additionally relates to a device for producing a connector arrangement, comprising a fixed contact for receiving the connector housing, and a crimper that can be moved relative to the fixed contact. The connector housing in this case is in a preassembled state, i.e. it is already enclosed by the crimp barrel and contains the cables respectively inserted into the individual leadthroughs.

The cross-sectional profile of a cavity enclosed by the fixed contact and the crimper when the crimping tool is in a closed state corresponds to the cross-sectional profile of the connector housing. It therefore has the cross-sectional profile of the individual first connector housing element that realizes the leadthroughs, or of the assembled first connector housing elements, and is consequently of an elliptical, oval, round or rounded polygonal shape.

In this way, such a device for producing a connector arrangement can be used to create a reliable frictional connection between the crimp barrel and the connector housing, and between the shielding of each cable and the connector housing.

A first aspect of the present invention is a connector arrangement comprising: at least two cables, each of the at least two cables having a cable sheath, and shielding arranged within the cable sheath, and the shielding arranged within the cable sheath of each of the at least two cables is exposed from the cable sheath at a cable end of each of the at least two cables; a connector housing made of an electrically conductive material, and the connector housing defines a leadthrough for each of the at least two cables, and the exposed shielding of each of the at least two cables is positioned within the respective leadthrough, and is frictionally connected to the connector housing, and a crimp barrel being frictionally connected to the connector housing at least partially enclosing the connector housing about the leadthrough defined in the connector housing for each of the at least two cables.

A second aspect of the present invention is a connector arrangement and further comprising: a first connector housing element of the connector housing, and the first connector housing element defines the leadthrough.

A third aspect of the present invention is a connector arrangement and further comprising: a second connector housing element, which has a shell-type design, and the second connector housing element is arranged between the crimp barrel and the first connector housing element.

A fourth aspect of the present invention is a connector arrangement and wherein the first connector housing element has a lateral boundary which defines a fixing region for axially and/or rotationally fixing the first connector housing element to the second connector housing element.

A fifth aspect of the present invention is a connector arrangement and further comprising: plural first connector housing elements, and each first connector housing element defines a first recess, and each of the plural first connector housing elements that define the first recess are arranged in relation to one another in such a manner that the first recesses define the leadthrough.

A sixth aspect of the present invention is a connector arrangement and further comprising: a second recess defined in each of the plural first connector housing elements; and the second recess defined in each of the plural first connector housing elements define a first-rib shaped region which forms a radial boundary of the leadthrough; a second rib-shaped region which forms a lateral boundary of each of the plural first connector housing element; and a third rib-shaped region which connects the first rib-shaped region and the second rib-shaped region in each of the plural first connector housing elements.

A seventh aspect of the present invention is a connector arrangement and further comprising: plural second recesses defined in each first connector housing element; and a plurality of fourth rib-shaped regions, and each of the plurality of fourth rib-shaped regions are arranged parallel to one another and axially spaced apart from one another; and at least one fifth rib-shaped region, which connects at least two of the plurality of the fourth rib-shaped regions.

An eighth aspect of the present invention is a connector arrangement and further comprising: a plurality of first connector housing elements, and each of the plurality of first connector housing elements has a guide region and; the plurality of first connector housing elements are joined by the guide regions.

A ninth aspect of the present invention is a connector arrangement and further comprising: at least one slot defined in the connector housing adjacent each leadthrough.

A tenth aspect of the present invention is a connector arrangement and further comprising: at least one radial extension positioned within the leadthrough and directed radially into the leadthrough.

An eleventh aspect of the present invention is a connector arrangement and wherein the crimp barrel defines at least one fold shaped portion.

A twelfth aspect of the present invention is a connector arrangement and further comprising: a support sleeve extending about the cable sheath, and the exposed shielding of the cable sheath is folded back around the support sleeve; and the support sleeve defines a plurality of elevations and/or depressions.

A thirteenth aspect of the present invention is a method for producing a connector arrangement comprising the steps: providing at least two cables, each of the at least two cables having a sheath and shielding within the sheath, and the shielding within the cable sheath is exposed from the cable sheath at an end of each of the at least two cables; inserting each of the at least two cables into the associated leadthrough defined by the connector housing; and frictionally connecting the connector housing to the cable and to the shielding with the crimp barrel.

A fourteenth aspect of the present invention is a device for producing a connector arrangement comprising: a fixed contact defining a cavity surface configured for receiving a first portion of a connector housing; a crimper defining a cavity surface configured for receiving a second portion of the connector housing, and the crimper is movable relative to the fixed contact; and a cavity is defined when the fixed contact and the crimper are moved to a position where the crimper is immediately adjacent the fixed contact, and the cavity defined thereby has a cross-sectional profile that corresponds to a cross-sectional profile of the connector housing.

Features described in connection with the connector arrangement according to the invention are clearly realizable for the connector housing element according to the invention, the method according to the invention for producing a connector arrangement, and the device according to the invention for producing a connector arrangement—and vice versa.

The above designs and developments in the individual embodiments and sub-variants may be combined with each other in any appropriate manner. Further possible designs, developments and implementations of the invention also include combinations of features of the invention, described above or in the following in respect of the exemplary embodiments, that are not mentioned explicitly. In particular, persons skilled in the art will also add individual aspects as improvements or additions to the respective basic form of the present invention.

BRIEF DESCRIPTION OF THE DRAWINGS

The present invention is explained in greater detail in the following on the basis of the exemplary embodiments given in the schematic figures of the included drawings.

DETAILED WRITTEN DESCRIPTION OF THE PREFERRED EMBODIMENTS

Figure 1A:
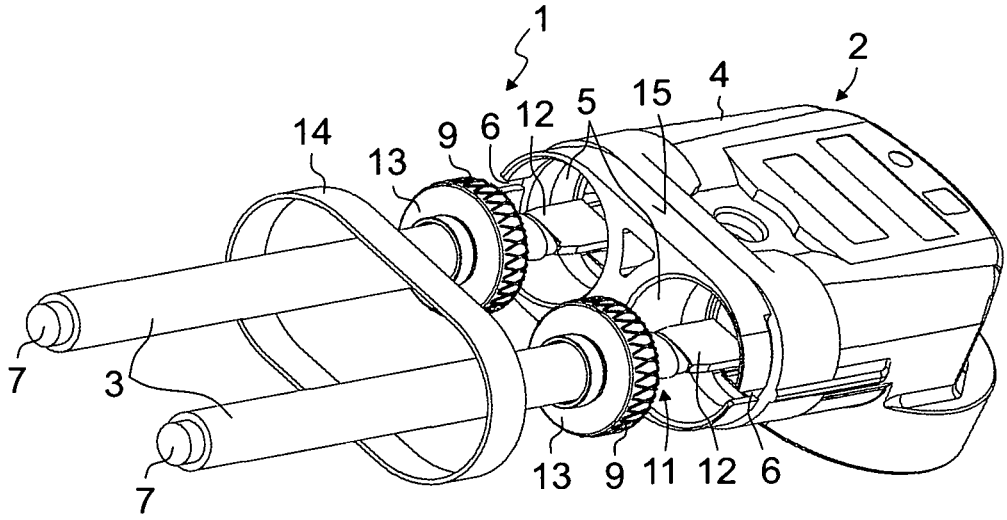
FIG. 1A is an isometric view representation of a first embodiment of a connector arrangement according to the invention, in an intermediate step of production.

The appended figures of the drawing are intended to provide further understanding of the embodiments of the invention. They illustrate embodiments and, in combination with the description, serve to explain principles and concepts of the invention. Other embodiments, and many of the advantages mentioned, are given by the drawings. The elements of the drawings are not necessarily true to scale.

In the figures of the drawing, elements, features and components that are the same, that have the same function and have the same effect, are in each case—unless otherwise specified—denoted by the same references.

In the following, the figures are described in a coherent and comprehensive manner.

In a first embodiment of the connector arrangement according to the invention, which is described in the following on the basis of FIGS. 1A, 1B and 1C, the connector housing is realized as one piece.

In the connector arrangement 1 according to FIG. 1A, two cables 3 are fed to a connector 2 of the connector arrangement 1. The connector 2 comprises, besides other components, a connector housing 4. For the purpose shielding the connector 2, the connector housing 4 is made of an electrically conductive material, in particular a metal.

In order to connect the two cables 3 to the connector 2, the connector housing 4 has two associated leadthroughs 5, through which the two cables 3 are passed from the outside into the interior of the connector housing 4. Formed in the connector housing 4, in the region of the leadthroughs 5, there is a respective slot 6, in order, in the crimping process, to reduce the diameter of the leadthrough 5 for the purpose of fixing the cable 3 in the leadthrough. The diameter of the leadthrough 5 when the connector arrangement is in the non-compressed state is realized so as to be slightly greater than the greatest diameter of the cable 3, in order to allow easy insertion of the cable 3 into the connector housing 4. The two leadthroughs 5 are realized adjacently in the connector housing 4, in order to connect the two cables 3 frictionally to the connector housing 4 in a single crimping operation by means of a common crimp barrel.

The cable 3 is typically constructed as follows, as shown in particular by FIG. 1C: A bundle of individual litz wires, stranded together, which form the inner conductor 7 inside the cable 3, is enclosed by an insulation 8. A shielding 9, made of a braid of interwoven metal wires, in turn encloses the insulation 8. Finally, an electrically insulating cable sheath 10 surrounds the shielding 9 of cable 3. At the cable end 11, the litz wire bundles of the inner conductor 7 are exposed from the insulation 8. The inner conductor 7 exposed from the insulation 8 is connected to a contact element 12, preferably by means of a welded joint. Alternatively, a crimped or soldered connection is also possible. Finally, it is also possible to compact the individual strands of the inner conductor 7 at the cable end 11 in a compacting process, and weld them together to form a contact element. At the cable end 11, the shielding 9 is also exposed from the cable sheath 10 over a certain longitudinal portion of the cable 3. The end of the cable sheath 10 encloses a metal support sleeve 13. The shielding 9 of the cable 3, which is exposed from the cable sheath 10, is folded back around the support sleeve 13.

Figure 1B:
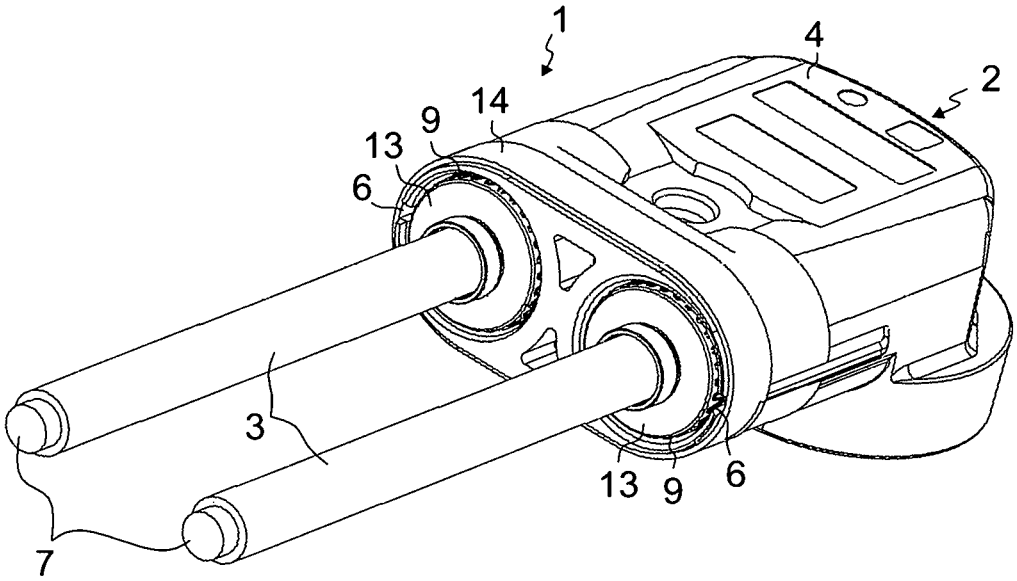
FIG. 1B is an isometric view representation of a first embodiment of a connector arrangement according to the invention, at the end of production.
Figure 1C:
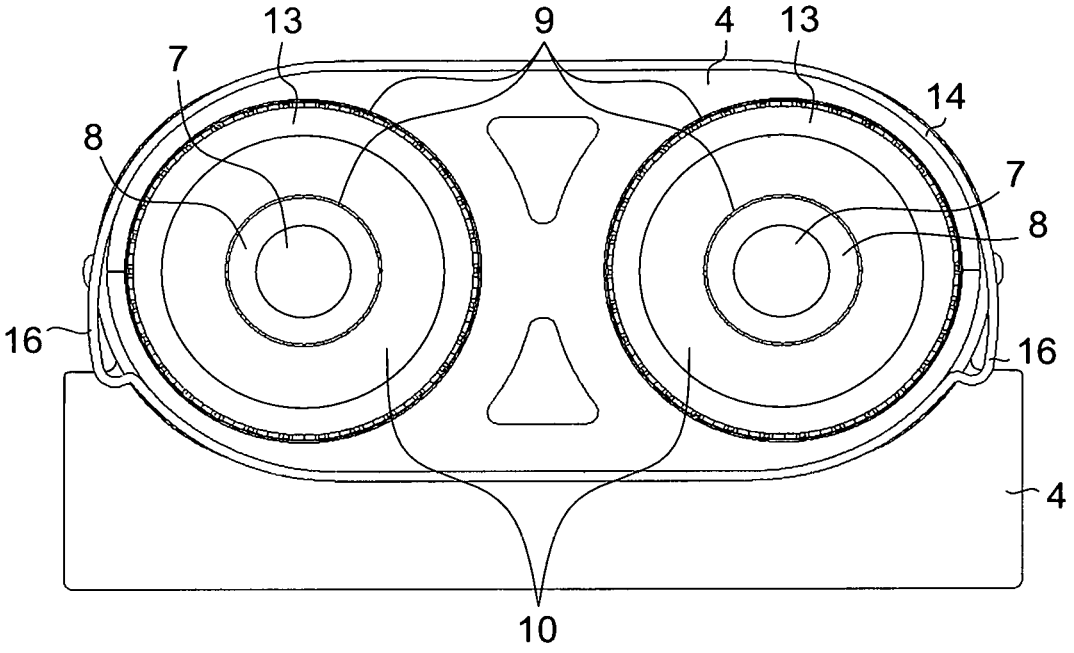
FIG. 1C is a cross-sectional view representation of a first embodiment of a connector arrangement according to the invention.

As shown by FIG. 1B, the two cables 3 are inserted into the associated leadthrough 5 of the connector housing 4 until the shielding 9, which in each case is folded back around the support sleeve 13, is positioned in the region of the associated leadthrough 5. In this way, as shown in FIG. 1B, it is possible to realize a frictional connection between the shielding 9 of each cable 3, which is folded back around the support sleeve 13, and the connector housing 4, within the associated leadthrough 5, by means of a crimping operation. Thus, an optimum shield transition is realized between the shielding 9 of each cable 3 and the shielding of the connector 2, which is realized by the metallic connector housing 4.

To realize the frictional connection between the shielding 9 of each cable 3 and the connector housing 4, a crimp barrel 14 is passed around the connector housing 4 in the region of the two leadthroughs 6 respectively realized in the connector housing 4. The crimp barrel 14 thus encloses the connector housing 4 and all leadthroughs 5 respectively realized in the connector housing 4, preferably over the entire circumference. The crimp barrel 14 thus also encloses the cables 3 respectively passed through the leadthroughs 5 in the region of the shielding 9 that is in each case folded back around and about the respective support sleeve 13. In order that the crimp barrel 14 can enclose the connector housing 4 and the leadthroughs 5 realized therein, the connector housing 4 has a sleeve-shaped bearing surface 15 for the crimp barrel 14. The axial width of this sleeve-shaped bearing surface 15 corresponds at least to the axial width of the crimp barrel 14. Preferably, it corresponds to the axial width of the crimp barrel 14.

The cross-sectional profile of this sleeve-shaped bearing surface 15 is realized in such a manner that the region of the connector housing 4 located between the sleeve-shaped bearing surface 15 encloses all leadthroughs 6 with a closest possible spacing. The region of the connector housing 4 located between this sleeve-shaped bearing surface 15 and the leadthroughs 6 must therefore be realized in such a manner that a deformation of this region of the connector housing 4 that is sufficient for the crimping process is possible. While the crimp barrel 14 must be deformed only plastically, the connector housing 4 may be deformed either plastically or only elastically. For the feeding of two cables 3 as shown in FIGS. 1A to 1C, an oval lateral cross-sectional profile of the sleeve-shaped supporting surface 15 proves to be advantageous. For a different number of cables 3 to be fed, and thus for other possible arrangements of the associated leadthroughs 5, an elliptical, round or polygonal, in particular a rounded polygonal, cross-sectional profile is conceivable, besides an oval cross-sectional profile.

In a crimping process by means of a suitably designed crimping tool, which will be described later, the crimping force exerted by the crimping tool upon the crimp barrel 14 causes the crimp barrel 14 to be frictionally connected to the connector housing 4. The crimping force of the crimping tool causes the region of the connector housing 4 that is located between the crimp barrel 14 to be deformed plastically, or purely elastically. In particular in this case, the lateral cross section of the individual leadthrough 5 is reduced, such that the shielding 9 of each cable 3 is frictionally connected to the corresponding inner wall of the connector housing 4 within the leadthrough 5. As a result of the reduction of the lateral cross-section of the individual leadthrough 5, in particular the slot 6 realized in each case in the connector housing 4, in the region of the leadthrough 5, is reduced, preferably closed. Due to the frictional connection, the crimp barrel 14 tightly encloses the connector housing 4 without inclusion of air.

The lateral circumference of the crimp barrel 14 is enlarged, compared to the lateral circumference of the connector housing 4 in the region of the leadthroughs 5, i.e. compared to the lateral cross-section of the sleeve-shaped bearing surface 14, when the connector housing 4 is in the non-compressed state, in order to allow the connector housing 4 to be easily enclosed by the crimp barrel 14 during assembly. The lateral circumference of the crimp barrel 14, which is necessary for the frictional enclosure of the plastically, or elastically, deformed connector housing 4, is consequently in comparison with the original lateral circumference. Following the crimping process, the crimp barrel 14 consequently has an excess length that is not required for the frictional connection to the connector housing 4. This excess length of the crimp barrel 14 is transformed by the crimping tool into at least one fold-shaped portion 16 of the crimp barrel 14, preferably into two fold-shaped portions 16 of the crimp barrel 14, as represented in FIG. 1C. The individual fold-shaped portion 16 of the crimp barrel 14 in this case projects from the connector housing 4.

In a second embodiment of the connector arrangement 1 according to the invention, which is described in the figures, the connector housing 4 is realized as a plurality of parts. The connector housing 4 has at least one first connector housing element 17, in which the leadthroughs 5 are realized. This at least one first connector housing element 17 is in each case plastically or elastically deformed in the crimping process by the surrounding crimp barrel 14. The plastic, or elastic, deformation of the at least one first connector housing element 17 results in a reduction of the lateral cross-section of the leadthroughs 5 realized therein, and thus in a frictional connection between the shielding 9 of the individual cable 3 and the connector housing 4.

Figure 2A:
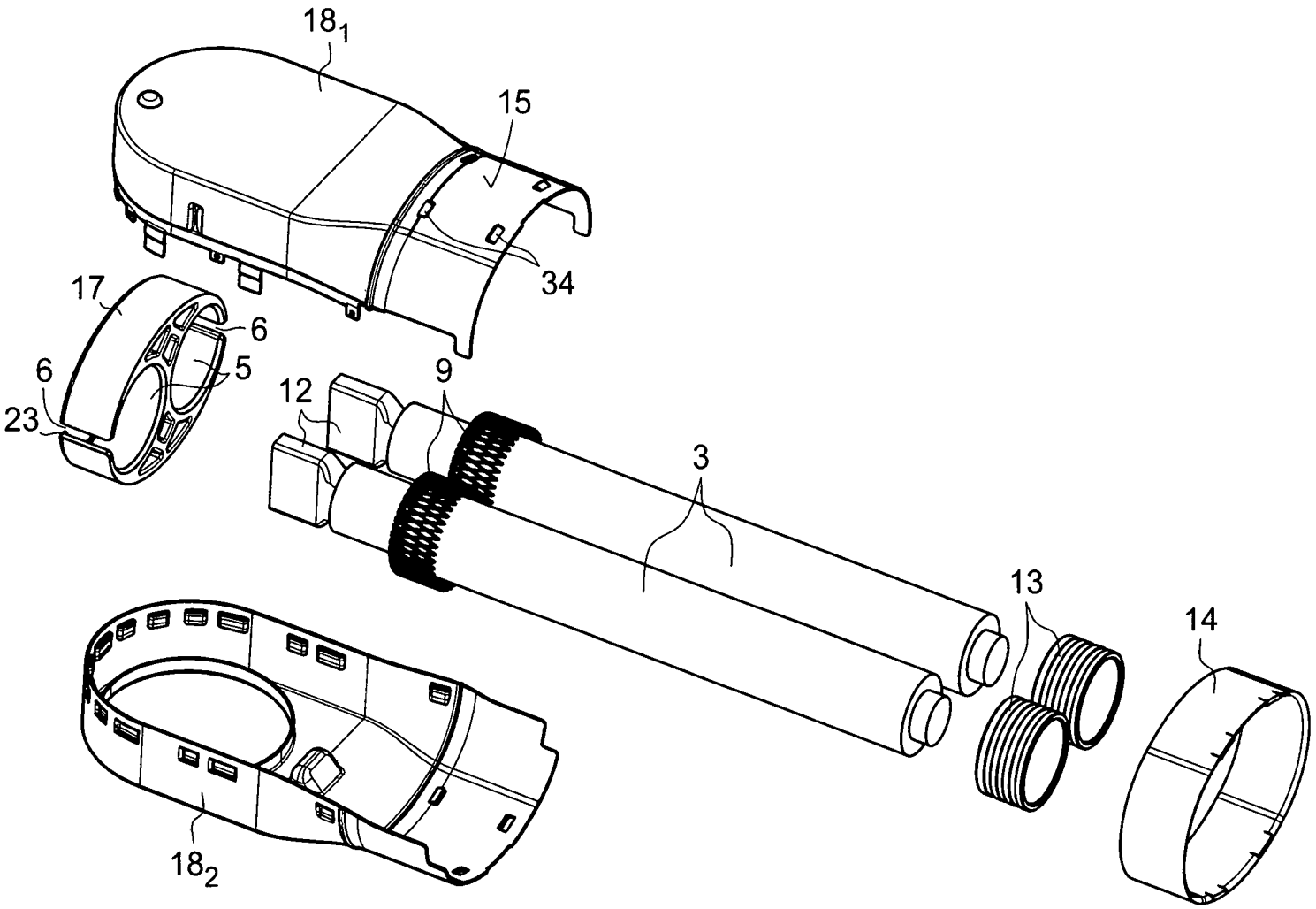
FIG. 2A is an exploded view representation of a first sub-variant of a second embodiment of a connector arrangement according to the invention, in a first intermediate step of production.
Figure 2B:
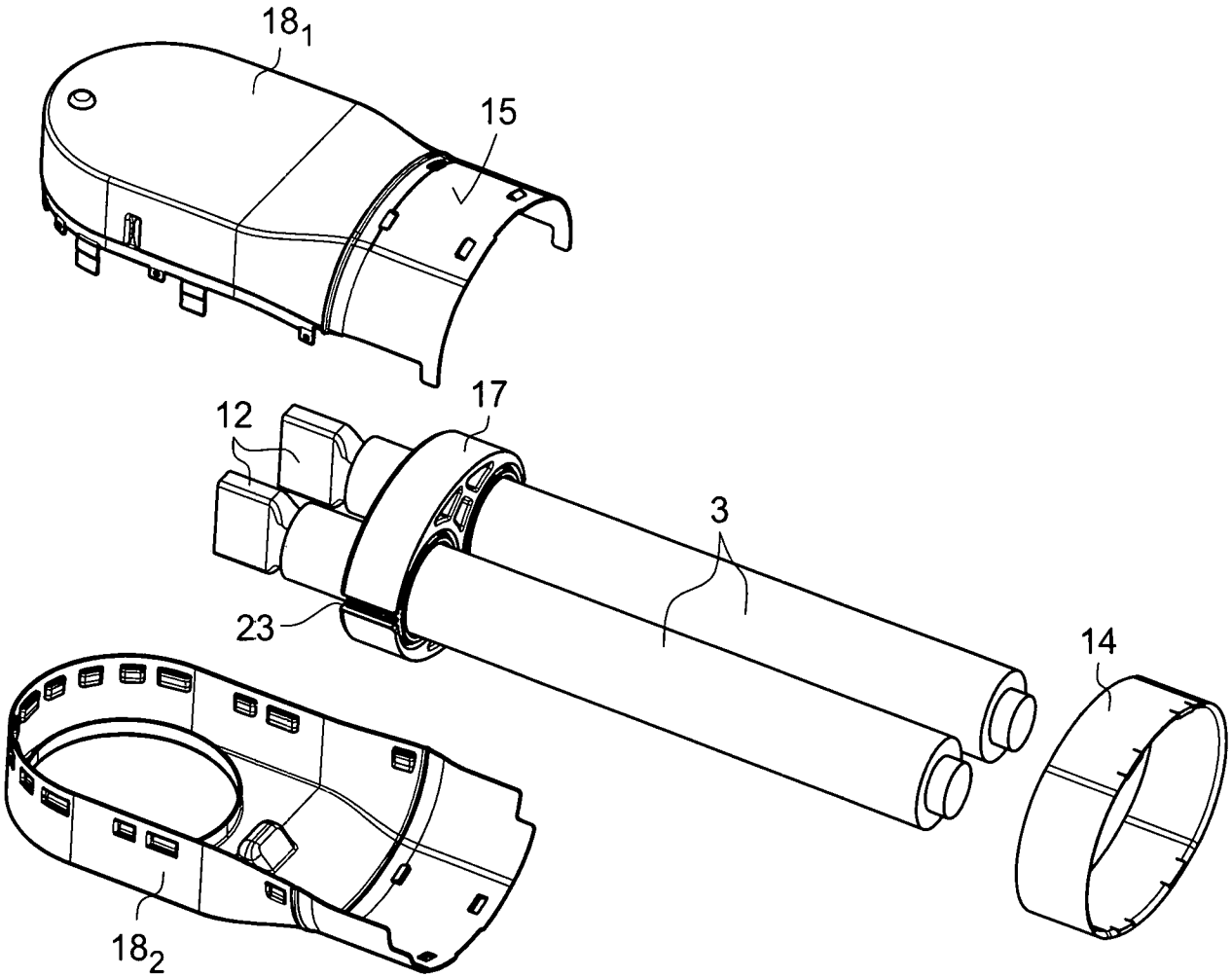
FIG. 2B is an exploded view representation of a first sub-variant of a second embodiment of a connector arrangement according to the invention, in a second intermediate step of production.
Figure 2C:
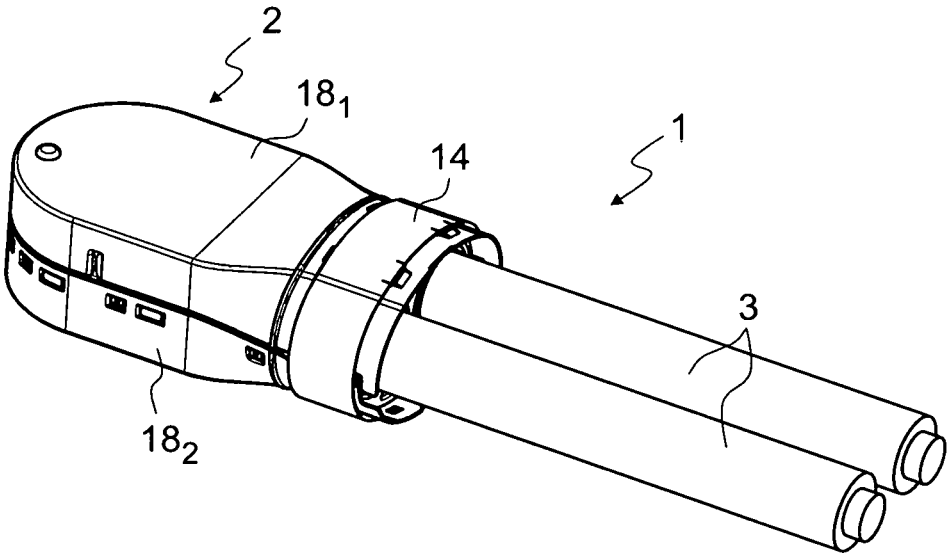
FIG. 2C is an isometric view representation of a first sub-variant of a second embodiment of a connector arrangement according to the invention, at the end of production.

The connector housing 4 additionally comprises at least one second connector housing element $\mathbf{18}_1$ and $\mathbf{18}_2$. The at least one second connector housing element $\mathbf{18}_1$ and $\mathbf{18}_2$ serves primarily to provide large-surface housing of the connector components integrated in connector 2, for example the contact elements 12, and is therefore in each case preferably shaped in the form of a shell. The shell-type design of the second connector housing elements $\mathbf{18}_1$ and $\mathbf{18}_2$ reduces the weight of the connector 2 and enables simple production, for example by means of a casting process. As shown by FIG. 2C, the at least one second connector housing element $\mathbf{18}_1$ and $\mathbf{18}_2$ is arranged between the crimp barrel 14 and the at least one first connector housing element 17.

On the outer surface of the at least one second connector housing element $18_1$ and $18_2$, a bearing surface 15 for the crimp barrel 14 is provided, as in the first embodiment of the connector arrangement 1 according to the invention. For the purpose of axially fixing the crimp barrel 14 on the bearing surface 15 of the connector housing 4, boundary regions 34, which are each oriented radially, are realized on the outer surface of the second connector housing element $18_1$ and $18_2$. The crimping process causes the second connector housing element $18_1$ and $18_2$ to be frictionally connected to the crimp barrel 14, and simultaneously to the first connector housing element 17.

In a first sub-variant of the second embodiment of connector arrangement 1 according to the invention described in FIGS. 2A, 2B, 2C and 2D, each leadthrough 5 is in each case realized in a single first connector housing element 17. In the special case of a first sub-variant of the second embodiment of the second embodiment of the connector arrangement 1 according to the invention respectively represented in FIGS. 2A to 2D, all leadthroughs 5 are realized in a single first connector housing element 17.

This special case is characterized by a minimum number of slots 6, formed in the first connector housing element 17. In the first connector housing element 17 respectively represented in FIGS. 2A to 2D, in each case a slot 6 is realized in the first connector housing element 17, between the individual leadthrough 5 and the lateral boundary of the first connector housing element 17, for each leadthrough 5. In an alternative to the one-piece first connector housing element 17 respectively represented in FIGS. 2A to 2D, a single slot 6 is realized between the two leadthroughs 5. Minimizing the number of slots in the first connector housing element 17 reduces the degrees of freedom of movement of the cables 3 in the individual leadthroughs 5 during the crimping operation, thus preventing unwanted deformation of, or damage to, the preassembled cable 3 and the associated support sleeve 13.

Figure 2D:
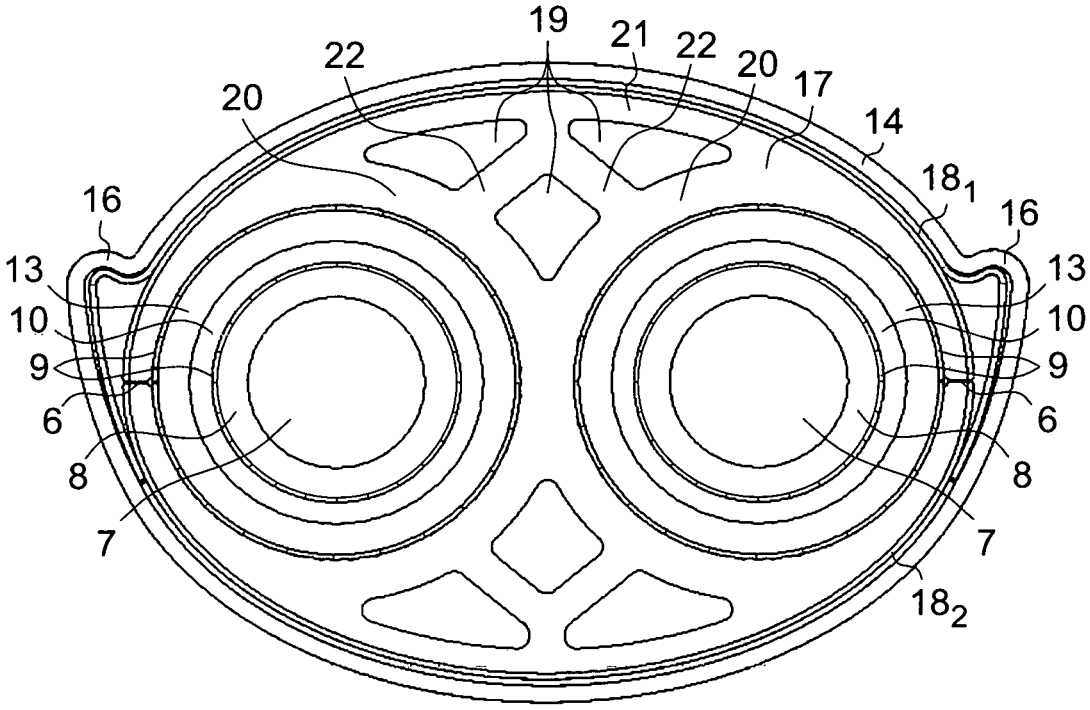
FIG. 2D is a cross-sectional view representation of a first sub-variant of a second embodiment of a connector arrangement according to the invention.

As can be seen in particular from the representation in FIG. 2D, a plurality of second recesses 19 are provided in the first connector housing element 17. The second recesses 19 are realized in those regions of the first connector housing element 17 in which no leadthroughs 5 are provided. The second recesses 19 are in each case realized between a parting plane, which is required for the casting process and is arranged centrally between the two axial end faces of the disk-shaped first connector housing element 17, and one of the two axial end faces in each case.

The realization of these second recesses 19 makes it possible, advantageously, to produce a connector housing element 17 optimized in respect of casting technology, from regions that each have a comparatively similar wall thickness.

The individual second recesses 19 in this case are realized in such a manner that first rib-shaped regions 20, second rib-shaped regions 21 and third rib-shaped regions 22 are realized in the first connector housing element 17. The first rib-shaped region 20 forms a portional boundary of a leadthrough 5. The second rib-shaped region 21 forms a portion of the lateral boundary of the first connector housing element 17. The third rib-shaped region 22 connects a first rib-shaped region 20 to a second rib-shaped region 21.

The third rib-shaped regions 22 of the connector housing element 17 each cause the crimping force, which is introduced into the first connector housing element 17 by the crimping tool either vertically or horizontally, i.e. perpendicularly in relation to the lateral boundary of the first connector housing element 17, to be deflected into a holding force that in each case is oriented radially with respect to the individual leadthrough 5. In this way, the inner wall of the first connector housing element 17 in the region of the individual leadthrough 5 is in each case radially compressed in a more uniform manner over the entire circumference, thus achieving a uniform frictional connection between the first connector housing element 17 and the shielding 9 of the individual cables 3.

In the first sub-variant of the second embodiment of the connector arrangement 1 according to the invention, the individual cable 3, with its shielding 9, which is in each case folded over around a support sleeve 13, is inserted axially into an associated leadthrough 5 of the first connector housing element 17. In order to fix the individual cable 3 axially in the first connector housing element 17, extensions 23 are preferably realized on the inner wall of the first connector housing element 17, at the end of the individual leadthrough 5 on the inside of the housing, which are in each case directed radially into the individual leadthrough 5, as shown by FIGS. 2A and 2B. The shielding 9 of the individual cable 3 is supported axially by these radially inwardly directed extensions 23 of the first connector housing element 17. Thus, in the first sub-variant of the second embodiment of the connector arrangement 1 according to the invention, the individual cable 3 is fixed in the connector housing 4 at least in an axial direction.

In a second sub-variant of the second embodiment of the connector arrangement 1 according to the invention, the individual leadthroughs 5 are each realized by the shaping and arrangement of a plurality of first connector housing elements $17_1$ and $17_2$.

In the connector arrangement 1 shown respectively in FIGS. 3A, 3B, 3C and 3D, three cables 3 are fed to one connector 2. The three cables 3 in this case are each inserted into an associated leadthrough 5 of the connector housing 4 that is realized by two first connector housing elements $17_1$ and $17_2$.

In the two first connector housing elements $17_1$ and $17_2$, a first recess 24 is in each case formed and arranged for each leadthrough 5 in such a manner that, when the two first connector housing elements $17_1$ and $17_2$ are joined together, the individual first recesses 24 that are joined together realize a leadthrough 5.

Figure 3A:
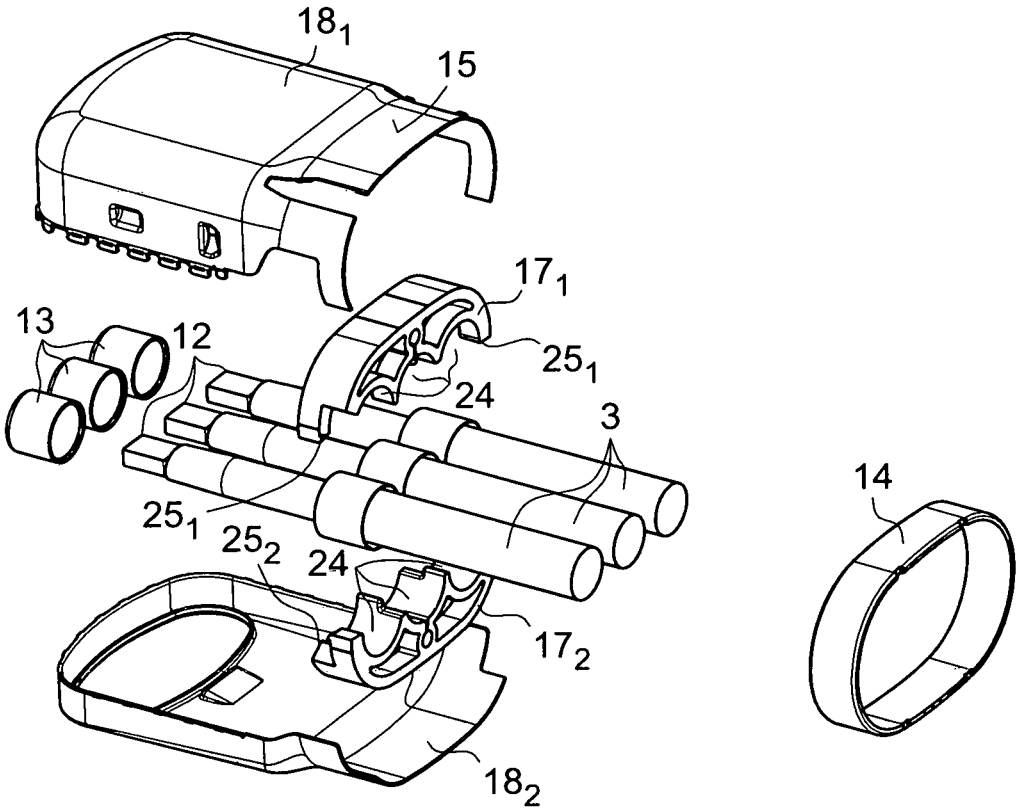
FIG. 3A is an exploded view representation of a second sub-variant of a second embodiment of a connector arrangement according to the invention, with three cables, in a first intermediate step of production.
Figure 3B:
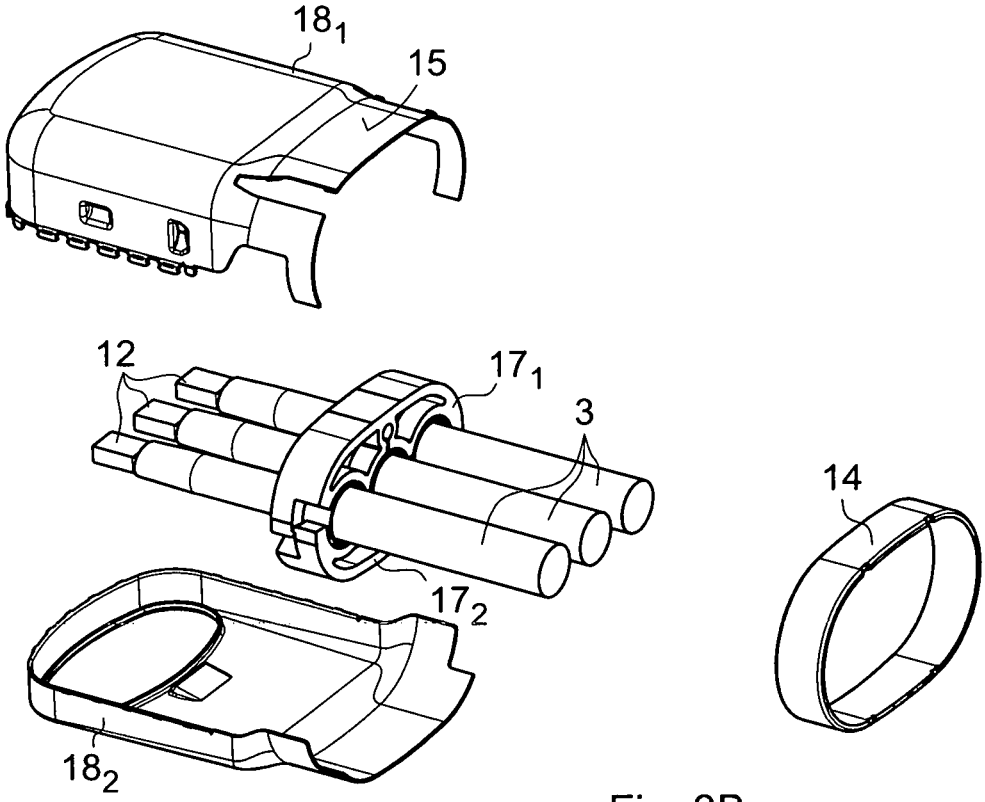
FIG. 3B is an exploded view representation of a second sub-variant of a second embodiment of a connector arrangement according to the invention, with three cables, in a second intermediate step of production.
Figure 3C:
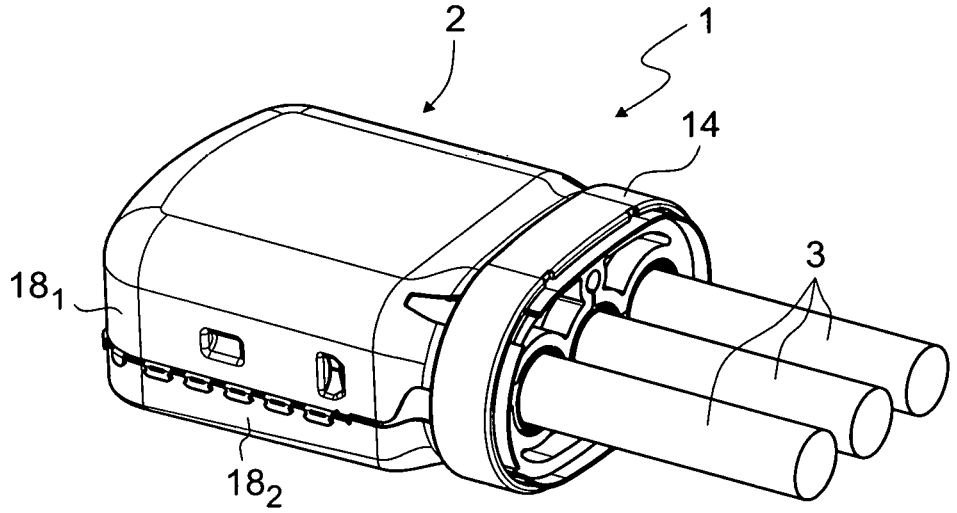
FIG. 3C is an isometric view representation of a second sub-variant of a second embodiment of a connector arrangement according to the invention, with three cables, at the end of production.

For the purpose of jointly joining the two first connector housing elements $17_1$ and $17_2$, realized on each first connector housing element $17_1$ and $17_2$ is a respective guide region $25_1$ and $25_2$, which correspond to each other. The guide regions $25_1$ and $25_2$ may be, for example, a guide rib and a guide groove that corresponds to it, as shown in FIG. 3A. Other mutually corresponding guide regions $25_1$ and $25_2$ such as, for example, a guide pin and a matching guide bore, are also conceivable. The two guide regions $25_1$ and $25_2$ are realized, respectively, on mutually adjacent contact surfaces, or contact regions, of the two first connector housing elements $17_1$ and $17_2$.

In the case of three cables, in particular, besides the realization of two first connector housing elements $17_1$ and $17_2$, a three-part realization of first connector housing elements, arranged in relation to one another, is also conceivable.

Figure 3D:
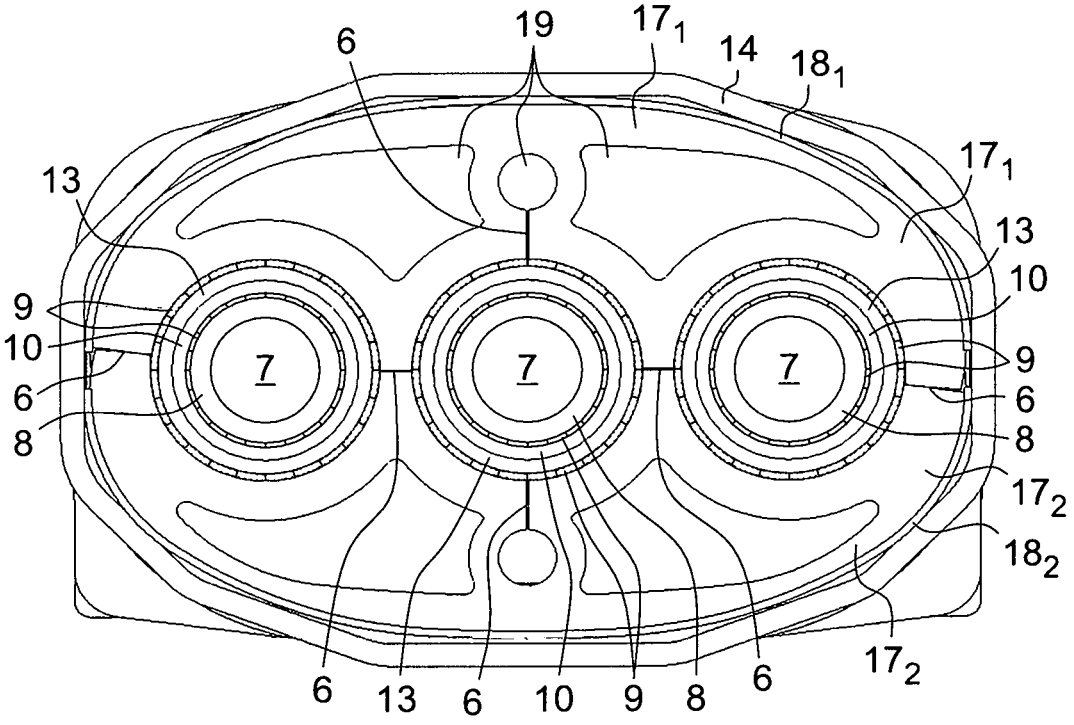
FIG. 3D is a cross-sectional view representation of a second sub-variant of a second embodiment of a connector arrangement according to the invention, with three cables.

The cross-sectional representation of FIG. 3D shows the two first connector housing elements $17_1$ and $17_2$ joined to each other, with the leadthroughs 5 realized therein, when the connector arrangement 1 is in the crimped, or compressed, state. The slots 6, which in the compressed state are closed, and which are located between the two first connector housing elements $17_1$ and $17_2$ that are joined together, can also be seen. Finally, FIG. 3D also shows a closed slot 6 between a leadthrough 5 and a second recess 19.

Whereas, in FIGS. 1D and 2C, the compressed crimp barrel 14 is in each case realized as a tension belt crimp, in FIG. 3D the crimp barrel 14 is alternatively formed as a so-called polygonal crimp, in particular a twelve-edged crimp. In order to realize the crimp barrel 14 with a total of twelve edges through the crimping process, an appropriately shaped crimping tool is required. The compressed crimp barrel 14, having a total of twelve edges, represents a best possible approximation to the oval cross-sectional profile of the two first connector housing elements $\mathbf{17}_1$ and $\mathbf{17}_2$ that are joined together. It thus enables a best possible homogeneous frictional connection between the crimp barrel 14 and the two joined first connector housing elements $\mathbf{17}_1$ and $\mathbf{17}_2$ and the second connector housing elements $\mathbf{18}_1$ and $\mathbf{18}_2$ arranged between them over the entire circumference.

FIGS. 4A, 4B, 4C and 4D each show a further version of a second sub-variant of the second embodiment of connector arrangement 1. In this case, two cables 3 are inserted into associated leadthroughs 5. The two leadthroughs 5 are each formed by two first recesses 24, which in turn are each formed and arranged in two first connector housing elements $\mathbf{17}_1$ and $\mathbf{17}_2$. Due to the cylindrical cross-sectional profile of the two leadthroughs 5, the associated first recesses 24 in the two first connector housing elements $\mathbf{17}_1$ and $\mathbf{17}_2$ are each semi-cylindrical.

Figure 4A:
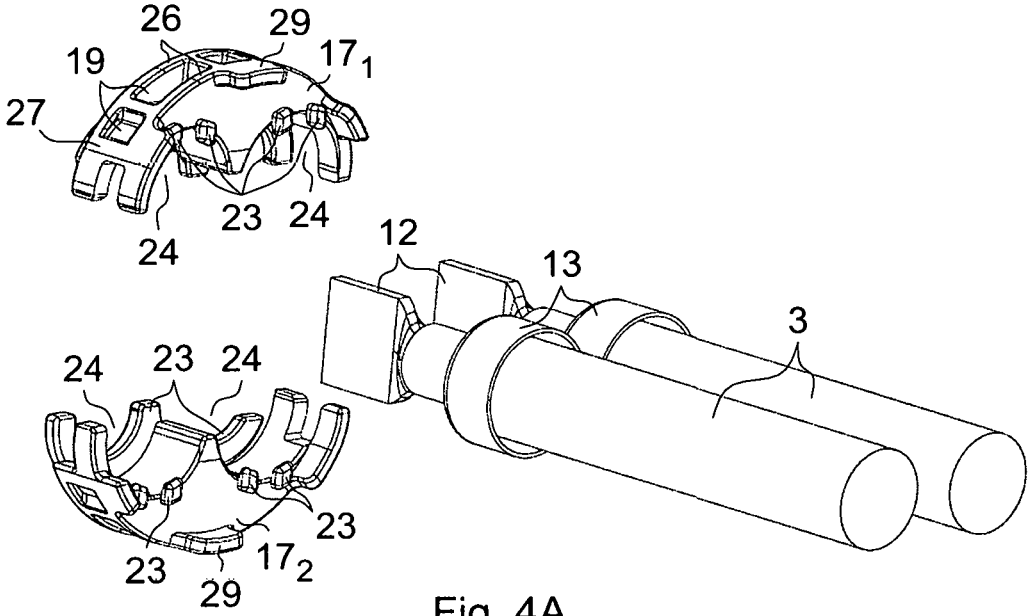
FIG. 4A is an exploded view representation of a second sub-variant of a second embodiment of a connector arrangement according to the invention, with two cables, in a first intermediate step of production.
Figure 4B:
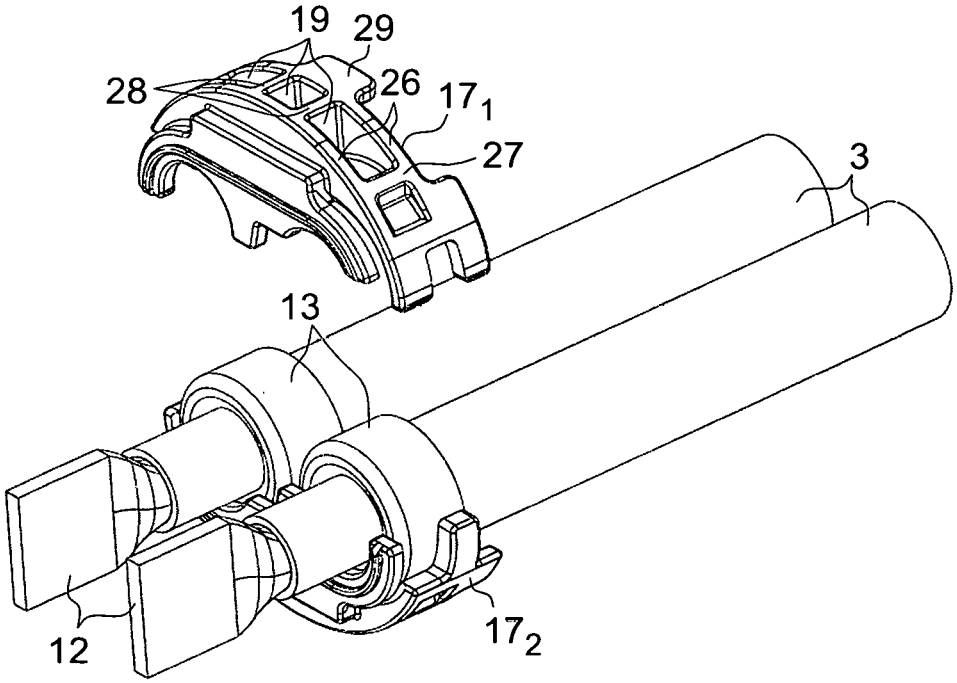
FIG. 4B is an exploded view representation of a second sub-variant of a second embodiment of a connector arrangement according to the invention, with two cables, in a second intermediate step of production.
Figure 4C:
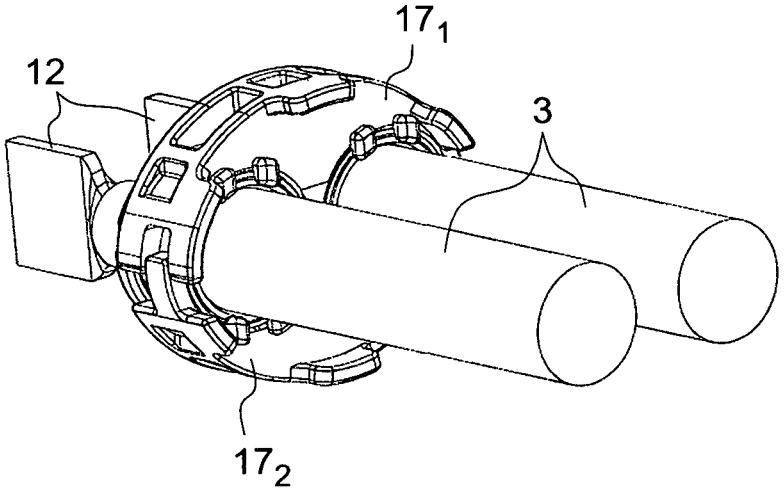
FIG. 4C is an isometric view representation of a second sub-variant of a second embodiment of a connector arrangement according to the invention, with two cables, at the end of production.
Figure 4D:
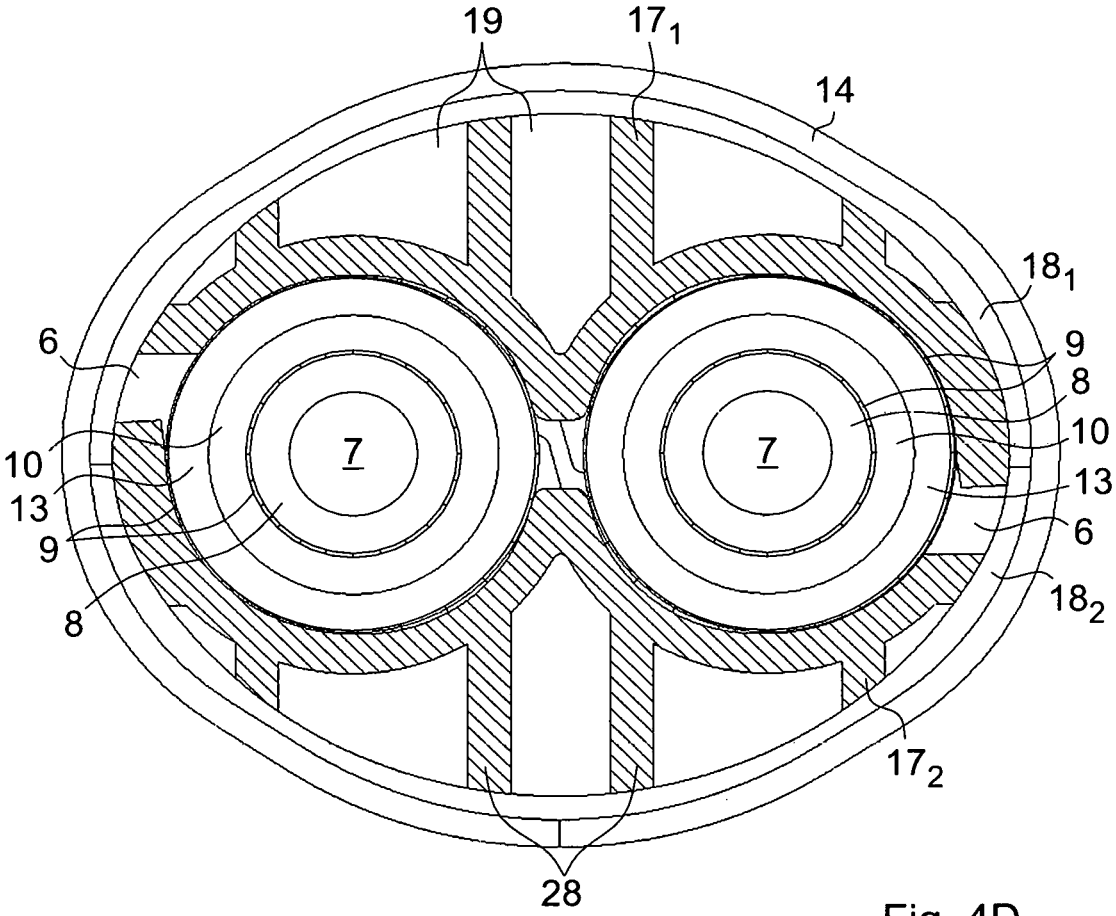
FIG. 4D is a cross-sectional view representation of a second sub-variant of a second embodiment of a connector arrangement according to the invention, with two cables.

Since the two first connector housing elements $\mathbf{17}_1$ and $\mathbf{17}_2$ are joined laterally to each other, lateral insertion of the two cables 3 into the two first connector housing elements $\mathbf{17}_1$ and $\mathbf{17}_2$ is also possible, as indicated in FIG. 4B. The lateral insertion of the individual cables 3 into the corresponding recesses 24 of the two first connector housing elements $\mathbf{17}_1$ and $\mathbf{17}_2$ allows the individual cables 3 to be fixed axially in the connector housing 4 in both axial directions.

In the two first connector housing elements $\mathbf{17}_1$ and $\mathbf{17}_2$, for this purpose there is in each case at least one radial extension 23 realized on the inner walls of the first recesses 24, in two axially mutually spaced positions, directed radially inward into the respective leadthrough 5. This radial extension 23 may in each case be realized as one piece, as a web realized over the entire circumference of the inner wall, or as a plurality of pieces, from a plurality of webs distributed in each case on the circumference of the inner wall, as can be seen from FIG. 4A. The radial extensions 23 are preferably each realized at ends of the individual leadthrough 5 on the inside of the housing and on the outside of the housing, and typically correspond to the axial extent of the support sleeve 13.

If the first connector housing elements $\mathbf{17}_1$ and $\mathbf{17}_2$ are of a multipart design, in the casting process the parting plane may be arranged, not only centrally and parallel to the two axial end faces of the first connector housing elements $\mathbf{17}_1$ and $\mathbf{17}_2$, but also, alternatively, in a plane perpendicular to them. This alternative arrangement of the parting plane allows second recesses 19 to be realized in the regions of the first connector housing elements $\mathbf{17}_1$ and $\mathbf{17}_2$ in which no leadthroughs 5 are formed. These second recesses 19 of the first connector housing elements $\mathbf{17}_1$ and $\mathbf{17}_2$ extend radially from the lateral boundary of the first connector housing elements $\mathbf{17}_1$ and $\mathbf{17}_2$ in the direction of the interior of the first connector housing elements $\mathbf{17}_1$ and $\mathbf{17}_2$. Thus, regions of the first connector housing elements $\mathbf{17}_1$ and $\mathbf{17}_2$ having a comparatively similar wall thickness can be realized, which are optimized in respect of casting technology.

In addition, a suitable shaping and arrangement of the second recesses 19 in the first connector housing elements $\mathbf{17}_1$ and $\mathbf{17}_2$ makes it possible to realize in each case fourth rib-shaped regions 26, which extend parallel to the end-face surfaces of the first connector housing elements $\mathbf{17}_1$ and $\mathbf{17}_2$. Between the two fourth rib-shaped regions 26, fifth rib-shaped regions 28 are additionally realized by the second recesses 19.

At the lateral boundary 27 of the first connector housing elements $\mathbf{17}_1$ and $\mathbf{17}_2$ a fixing region 29 is formed in each case. The fixing region 29 of the first connector housing elements $\mathbf{17}_1$ and $\mathbf{17}_2$ acts in combination with a corresponding fixing region of the second connector housing elements $\mathbf{18}_1$ and $\mathbf{18}_2$ to fix the first connector housing elements $\mathbf{17}_1$ and $\mathbf{17}_2$ axially and rotationally in relation to the second connector housing elements $\mathbf{18}_1$ and $\mathbf{18}_2$. The fixing region 29 is typically shaped in the form of a plate, and engages with a correspondingly shaped recess of the second connector housing elements $\mathbf{18}_1$ and $\mathbf{18}_2$. Alternatively, a rod-shaped form for the fixing region 27 is also conceivable.

Figure 5:
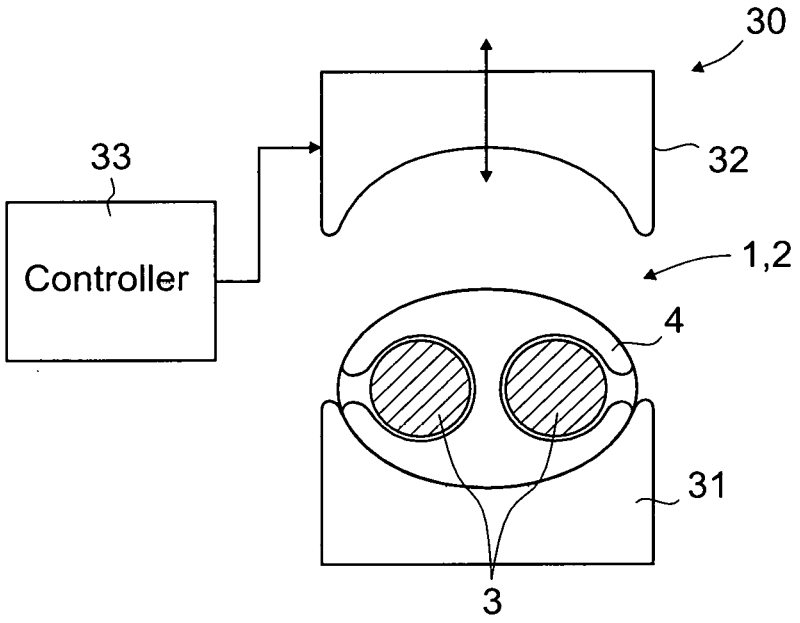
FIG. 5 is an orthographic view representation of a device for producing a connector arrangement according to the invention.

FIG. 5 shows a device 30 according to the invention for producing a connector arrangement 1. This device 30 for producing a connector arrangement 1 according to the invention includes a fixed contact 31 and a crimper 32 as crimping tools. The crimper 32 can be moved relative to the fixed contact 31, as indicated by the double arrow in FIG. 5. Control of the movement of the crimper 32 relative to the fixed contact 31, which is positioned in a fixed manner, is effected by a controller 33. The controller 33 may also optionally adjust the crimping force with which the crimper 32 acts on the connector housing 4 of connector 2. A movement of the crimper 32 having an adjustable force-displacement curve is also conceivable by means of the controller 33.

The cross-sectional profile of a cavity enclosed by the fixed contact 31 and the crimper 32 when the crimping tool is in the closed state, i.e. when the fixed contact 31 and the crimper 32 are in the closed state, corresponds to a cross-sectional profile of the crimped or compressed connector housing 4. If, for example, the cross-sectional profile of the connector housing 4 is oval, as indicated in FIG. 5, then the cavity formed by the fixed contact 31 and the crimper 32 is also oval when the crimping tool is in the closed state. In the case of an elliptical or oval cross-sectional profile of the connector housing 4, the relative movement of the crimper 32 in relation to the fixed contact 31 and in relation to the connector housing 4 arranged in the fixed contact 31 may be effected along the shorter minor axis of the ellipse or oval, as represented in FIG. 5. Alternatively, the relative movement of the crimper 32 in relation to the fixed contact 31 and in relation to the connector housing 4 arranged in the fixed contact 31 may also be along the longer major axis of the ellipse or oval.

Figure 6:
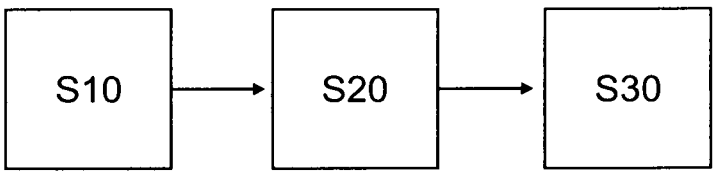
FIG. 6 is a flow diagram of a method for producing a connector arrangement according to the invention.

FIG. 6 shows the individual method steps of the method according to the invention for producing a connector arrangement 1:

In a first method step S10, a plurality of preassembled cables 3 are provided, which are to be fed to the connector 2 of the connector arrangement. A preassembled cable 3 in this case means at least one cable 3 at whose cable end 11 the litz wire bundle of the inner conductor 7 is exposed from the insulation 8 and is preferably connected to an associated contact element 12. In addition, in a preassembled cable 3, the shielding 9 is exposed from the cable sheath 10 at the cable end 11. Finally, in a preassembled cable 3, the end of the cable sheath 10 is enclosed by a support sleeve 13, around which the exposed shielding 9 is folded back.

In a further method step S20, a cable 3 preassembled and prepared in this manner is inserted into an associated leadthrough 5 realized in the connector housing 4 of connector 2.

Preferably, a crimp barrel 14 is already resting on a bearing surface 15 of the connector housing 4 and thereby encloses the then present connector housing 4 and the leadthroughs 5 realized in it.

In a final method step S30, a frictional connection between the crimp barrel 14 and the connector housing 4, and thus also a frictional connection between the connector housing 4 and the shielding 9 of the individual cables 3, is created in a compression or crimping process by means of a crimping tool.

Although the present invention has been described above entirely on the basis of preferred exemplary embodiments, it is not limited to these, but may be modified in a multiplicity of ways.

LIST OF REFERENCES

1 connector arrangement
2 connector
3 cable
4 connector housing
5 leadthrough
6 slot
7 inner conductor
8 insulation
9 shielding
10 cable sheath
11 cable end
12 contact element
13 support sleeve
14 crimp barrel
15 bearing surface
16 fold-shaped region
17,17$_1$,17$_2$ first connector housing element
18$_1$,18$_2$ second connector housing element
19 second recess
20 first rib-shaped region
21 second rib-shaped region
22 third rib-shaped region
23 radial extension
24 first recess
25$_1$,25$_2$ guide region
26 fourth rib-shaped region
27 lateral boundary
28 fifth rib-shaped region
29 fixing region
30 device for producing a connector arrangement
31 fixed contact
32 crimper
33 controller
34 boundary region In compliance with the statute, the present invention has been described in language more or less specific, as to structural and methodical features. It is to be understood, however, that the invention is not limited to the specific features shown and described since the means herein disclosed comprise preferred forms of putting the invention into effect. The invention is, therefore, claimed in any of its forms or modifications within the proper scope of the appended claims appropriately interpreted in accordance with the Doctrine of Equivalents.

The invention claimed is:

1. A connector arrangement comprising:

at least two cables, each of the at least two cables having a cable sheath, and shielding arranged within the cable sheath, and the shielding arranged within the cable sheath of each of the at least two cables is exposed from the cable sheath at a cable end of each of the at least two cables;

a connector housing made of an electrically conductive material, and the electrically conductive connector housing defines a leadthrough for each of the at least two cables, and the exposed shielding of each of the at least two cables is positioned within the respective leadthrough, and is frictionally connected to the electrically conductive connector housing; and a crimp barrel frictionally connected to the electrically conductive connector housing and at least partially enclosing the electrically conductive connector housing about the leadthrough for each of the at least two cables defined in the electrically conductive connector housing; and wherein the crimp barrel lies on, and makes contact with, a bearing surface of the electrically conductive connector housing, and the bearing surface encloses a region of the electrically conductive connector housing in which the leadthrough for each of the at least two cables is defined.

2. The connector arrangement of claim 1 and further comprising:

at least one slot defined in the connector housing adjacent each leadthrough.

3. The connector arrangement of claim 1 further comprising:

at least one radial extension positioned within the leadthrough and directed radially into the leadthrough.

4. The connector arrangement of claim 1 and wherein the crimp barrel defines at least one fold shaped portion.

5. The connector arrangement of claim 1 further comprising:

a support sleeve extending about the cable sheath, and the exposed shielding of the cable sheath is folded back around the support sleeve; and the support sleeve defines a plurality of elevations and/or depressions.

6. The connector arrangement of claim 1 and further comprising:

a first connector housing element of the connector housing, and the first connector housing element defines the leadthrough.

7. The connector arrangement of claim 6 further comprising:

a plurality of first connector housing elements, and each of the plurality of first connector housing elements has a guide region and;

the plurality of first connector housing elements are joined by the guide regions.

8. The connector arrangement of claim 6 further comprising:

a second connector housing element, which has a shell-type design, and the second connector housing element is arranged between the crimp barrel and the first connector housing element.

9. The connector arrangement of claim 8 wherein the first connector housing element has a lateral boundary which defines a fixing region for axially and/or rotationally fixing the first connector housing element to the second connector housing element.

10. The connector arrangement of claim 6 and further comprising:

plural first connector housing elements, and each of the plural first connector housing elements defines a first recess, and each of the plural first connector housing elements that define the first recess are arranged in relation to one another in such a manner that the first recesses define the leadthrough.

11. The connector arrangement of claim 10 further comprising:

a second recess defined in each of the plural first connector housing elements; and the second recess defined in each of the plural first connector housing elements define a first-rib shaped region which forms a radial boundary of the leadthrough; and a second rib-shaped region which forms a lateral boundary of each of the plural first connector housing elements; and a third rib-shaped region which connects the first rib-shaped region and the second rib-shaped region in each of the plural first connector housing elements.

12. The connector arrangement of claim 11 further comprising:

plural second recesses defined in each first connector housing element; and a plurality of fourth rib-shaped regions, and each of the plurality of fourth rib-shaped regions are arranged parallel to one another and axially spaced apart from one another; and at least one fifth rib-shaped region, which connects at least two of the plurality of the fourth rib-shaped regions.

13. A method for producing a connector arrangement comprising the steps:

providing at least two cables, each of the at least two cables having a cable sheath, and each of the at least two cables has shielding within the respective cable sheath, and the shielding within the respective cable sheath is exposed from the cable sheath at an end of each of the at least two cables;

providing a connector housing that is formed of an electrically conductive material, and the electrically conductive connecter hogging defines a leadthrough for each of the at least two cables; and inserting each of the at least two cables into the associated leadthrough defined by the electrically conductive connector housing so that the exposed shielding is within the leadthrguqh and the exposed shielding is in frictional contact with the electrically conductive connector housing; and providing a crimp barrel; and connecting the electrically conductive connector housing to each of the at least two cables and to the exposed shielding of the respective at least two cables with the crimp barrel.

14. A connector arrangement comprising:

at least two cables, each of the at least two cables having a cable sheath, and shielding arranged within the cable sheath, and the shielding arranged within the cable sheath of each of the at least two cables is exposed from the cable sheath at a cable end of each of the at least two cables;

a connector housing made of an electrically conductive material, and the connector housing defines a respective leadthrough for each of the at least two cables, and the exposed shielding of each of the at least two cables is positioned within the respective leadthrough, and is frictionally connected to the connector housing; and a crimp barrel frictionally connected to the connector housing and at least partially enclosing the connector housing about the leadthrough defined in the connector housing for each of the at least two cables; and a support sleeve extending about the cable sheath, and the exposed shielding of the cable sheath is folded back around the support sleeve.

* * * * *